United States Patent [19]

Kaplan

[11] 4,031,786

[45] June 28, 1977

[54] TONE SELECTOR CIRCUIT WITH MULTIPLEXED TONE DATA TRANSFER

[75] Inventor: Howard B. Kaplan, Lynnwood, Wash.

[73] Assignee: Warwick Electronics Inc., Chicago, Ill.

[22] Filed: Aug. 11, 1975

[21] Appl. No.: 603,860

[52] U.S. Cl. ..... 84/1.03; 84/1.24

[51] Int. Cl.[2] ..... G10F 1/00

[58] Field of Search ..... 84/1.01, 1.03, 1.11, 84/1.13, 1.19, 1.17, 1.28, DIG. 11

[56] References Cited

UNITED STATES PATENTS

| | | | |
|---|---|---|---|
| 3,610,799 | 10/1971 | Watson | 84/1.01 |
| 3,614,287 | 10/1971 | Amano | 84/1.01 |
| 3,683,096 | 8/1972 | Peterson | 84/1.03 |
| 3,697,661 | 10/1972 | Deutsch | 84/1.01 |
| 3,746,773 | 7/1973 | Uetrecht | 84/1.17 |
| 3,755,008 | 8/1973 | Deutsch | 84/1.28 |
| 3,842,702 | 10/1974 | Tsundoo | 84/DIG. 11 |
| 3,844,379 | 10/1974 | Tomisawa | 84/1.01 |
| 3,882,751 | 5/1975 | Tomisawa et al. | 84/1.01 |
| 3,889,568 | 6/1975 | Amata | 84/1.01 |
| 3,905,267 | 9/1975 | Vincent | 84/1.03 |
| 3,929,051 | 12/1975 | Moore | 84/1.03 |

*Primary Examiner*—Robert K. Schaefer

*Assistant Examiner*—Vit W. Miska

*Attorney, Agent, or Firm*—Wegner, Stellman, McCord, Wiles & Wood

[57] ABSTRACT

An electric organ utilizes digital encoding and time division multiplexing to both transfer function selection and note selection information from manually operable switches to respective memories, and to simultaneously produce a plurality of tone signals corresponding to stored note selection information. A single encoding circuit during successive scanning periods established by a single multiplexing circuit encodes in binary form the function and note selection information. A plurality of stored note codes are transferred on a time division multiplexing basis to a note selector which selectively produces in multiplexed form on one output all of the tone signals. These tone signals are demultiplexed to generate a corresponding plurality of tone signal outputs. An octave selection circuit responsive to a part of each note code selectively reduces the frequency of the demultiplexed tone signals. In response to storage of the code for a memory function, the note code memory operates to maintain note codes in storage after deactuation of the switches corresponding thereto until automatically updated with new note codes in response to selection of a new set of notes.

19 Claims, 18 Drawing Figures

FROM AUTO CODE GENERATOR 108
AUTO FUNCTION SELECTION CKT 34

A
B
C
D
E
F
G
ROOT
FIFTH
IE-4
IE-5
132
128
126
134
110
WB
FFO
FF1
ARP
STR
AP
AM
RY
PL/H
124
MANUAL FUNCTION SELECTION CKT 36
I-1
I-2
I-3
I-4
I-5
I-6
I-7
I-8
I-9
I-10
I-11
I-12

MEMORY RESET GENERATOR 362
MEMORY COUNTER DECODER 361'
MEMORY CONTROL COUNTER 360
MEMORY ENABLE GENERATOR 364
GATING LOGIC CIRCUIT 366'
DETECTION CIRCUIT 365
TO GATE 393
TO GATE 373
DELAY
ONE SHOT
0 NOTES
1 NOTE
2 NOTES
3 NOTES
4 NOTES
MR-1
MR-2
MR-3
MR-4
ME-1
ME-2
ME-3
ME-4
IR
AM
U
VI
CP
CS
DI3

TONE SELECTOR CIRCUIT WITH MULTIPLEXED TONE DATA TRANSFER

BACKGROUND OF THE INVENTION

This invention relates to an electrical musical instrument in which time division multiplexing techniques are employed to selectively generate musical tone signals in accordance with coded note information.

Electrical musical instruments, such as electronic organs, are known in which tone signals are selectively produced in accordance ith stored binary coded note information. A tone selector circuit for performing this function may comprise a plurality of logic gates respectively connected with a plurality of tone signal generators. Each gate produces its generated tone signal in response to a corresponding binary code being applied to its other inputs. Typically, twelve such gates are provided for respectively producing the twelve tone signals of an octave. Each tone selector circuit is capable of generating only one selected tone signal at a time, but must be capable of responding to any one of twelve codes. Thus, in order to provide a capability of simultaneously generating a plurality of tone signals, an equal plurality of tone selector circuits must be provided. In such a system, a storage element, capable of storing the codes of any one of the twelve tone signals, is associated with each one of the tone selectors. An example of such a system is shown in U.S. Pat. No. 3,884,379 of Tomisawa et al, in which a channel CN having a tone selector of the general type described above must be provided for each tone signal to be simultaneously produced.

Each of the tone selectors may be considered as a randomly assignable tone generator, since each tone selector can generate any one of the twelve tone signals depending upon which code is provided thereto. A system utilizing randomly assignable tone generators is described in U.S. Pat. No. 3,610,799 of Watson with reference to FIGS. 6, 7*a* and 7*b* thereof.

Another tone selection scheme requires the use of note code storage elements equal in number to the total number of selectable tone signals. In many applications, however, such as when the codes are developed from an accompaniment keyboard which is intended to be played with a single hand, no more than four of five note codes are selected at any one time. In such cases, the unneeded storage elements add substantially to the complication and expense of the circuit, without resulting advantage.

SUMMARY OF THE INVENTION

The electrical musical instrument of the present invention overcomes the disadvantages of prior tone selection systems by means of a unique tone selection system which utilizes a single selector circuit on a time division basis, and then demultiplexes the multiplexed tones to simultaneously produce a plurality of tone signals. A plurality of note codes representative of selected ones of the tone signals may be respectively stored in a plurality of storage elements. The number of storage elements is equal to (rather than greater than) the total number of tone signals which can be played at one time. Each storage element may store the code of any one of the twelve tone signals associated with the tone selector. The plurality of note codes are successively transferred to the tone selector on a time division multiplex basis, and the tone selector in response thereto selectively produces time division multiplex signals on a single output. The multiplexed tone signals produced at the signal output are then demultiplexed by a plurality of unique tone latch circuits corresponding in number to the note code storage elements. The plurality of tone latches respectively demultiplex the tone signals selected from the plurality of tone latches. All of the selected demultiplex tone signals are simultaneously produced.

Thus, a principle object of the present invention is the provision of an electrical musical instrument in which a plurality of tone signals may be simultaneously produced by circuitry employing only a single tone selector. The single tone selector is selected in accordance with a corresponding plurality of note codes stored in a number of storage elements no greater than the total number of tone signals which can be generated at one time. A savings in complexity, size and cost results by transferring the stored note code information to the single tone selector on a time division multiplex basis.

Other objects and features of the invention will be apparent from the following description and from the drawings. While illustrative embodiments of the invention are shown in the drawings and will be described in detail herein, the invention is susceptible of embodiment in many diferent forms and it should be understood that the present disclosure is to be considered as an exemplification of the principles of the invention and is not intended to limit the invention to the embodiments illustrated.

DESCRIPTION OF THE PREFERRED EMBODIMENT

I. Organization of the Musical Instrument

Figure 1:
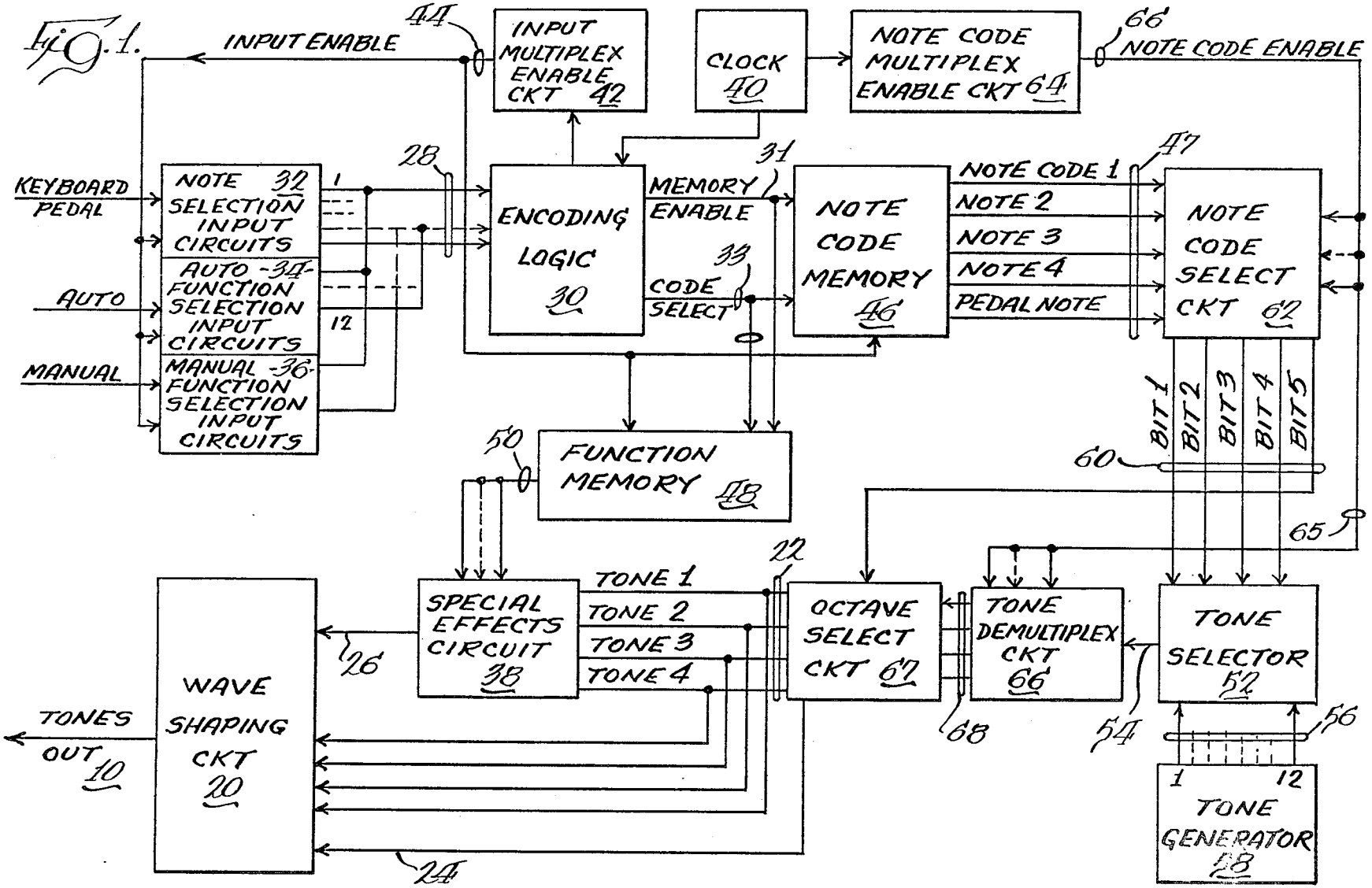
FIG. 1 is a simplified functional block diagram of an electrical musical instrument employing the invention.
Figure 2:
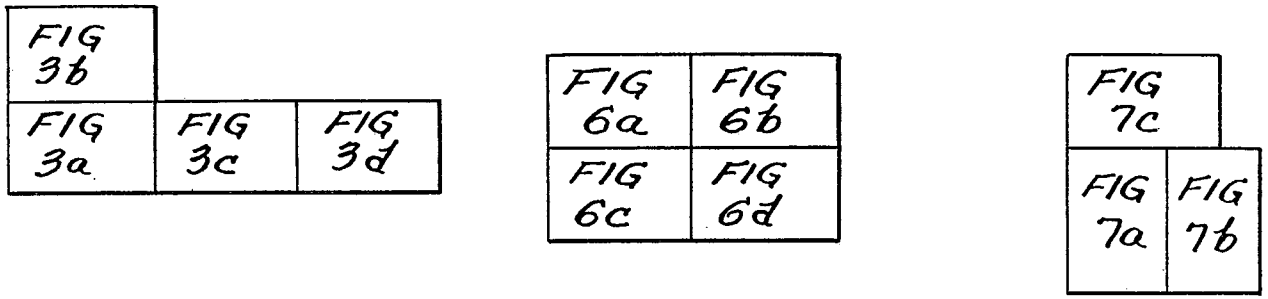
FIG. 2 is an illustration of the manner in which some of the subsequent figures of the drawings may be arranged into groups with each group comprising a continuous line schematic.

The electronic organ or other keyboard electrical musical instrument shown in simplified block diagram form in FIG. 1 includes a wave shaping circuit 20 to which are provided selected rectangular wave tone signals on tone signal input leads 22, 24 and 26. The wave shaping circuit 20 is conventional and may comprise any one of a number of known circuits for converting a rectangular tone waveform to a desired tone waveform by selecting sound waveform characteristics which are unique to the various musical instruments which are desired to be imitated by the electronic organs. Examples of such wave shaping circuits are shown in U.S. Pat. Nos. 3,515,791 and 3,778,525. The wave shaped tone signals may be combined on a single output, as illustrated, or on separate outputs and applied to a suitable speaker(s) (not shown) for conversion to audible sound.

The tone signals, differing only in frequency and corresponding to the different notes of a musical scale, are selected in accordance with signals applied to twelve inputs 28 of an encoding logic circuit 30. Input signals are applied to inputs 28 from each of one or more mamual note selection input circuits 32, auto function selection input circuits 34 and manual function selection input circuits 36 on a time division multiplex basis, as will be explained in more detail hereinafter. The signals from manual note selection input circuits 32 are representative of notes of a musical scale that have been selected by the organist by depressing keys of a manual keyboard or a pedal of a pedal clavier. On the other hand, the signals from each of the manual and auto function selection input circuits 34 and 36 do not represent notes of a musical scale, but rather represent functions to be performed by special effects circuitry 38. When a particular special effects function is selected, a corresponding function command signal is provided to the special effects circuitry 38. The special effects circuitry 38 generates tone signals on its output 26 in accordance with the command signals.

The details of the special effects circuit 38 are not a part of the invention and any circuit that will perform a desired automatic function in response to a command signal may be used. Examples of suitable special effects circuits are shown in U.S. Pat. Nos. 3,309,454 and 3,518,352, and reference may be had thereto for the manner of operation. Generally, these special effects, such as arpeggio, strum, etc., are performed by gating through to output 26 the various tone signals on outputs 22 selected by means of the note selection input circuits 32. However other special effects are performed by generating additional tone signals which are related to the selected tone signals on outputs 22. Thus, the note selection input circuits 32 are intended to be utilized with the special effects circuitry to produce accompaniment to a tune to be played on a solo or upper manual portion of the electronic organ (not shown). Conventional circuitry may also be provided for the upper manual portion of the organ.

The transfer of information necessary to achieve the desired tone generation and accompaniment effect function is achieved by binary coding, time division multiplexing and digital logic techniques. The input information from each of the input circuits is represented in binary form according to a positive logic convention (a high voltage corresponding to a logic 1-state and a low voltage or ground corresponding to a logic 0-state) and this system is used throughout the following description. It should be appreciated, however, that an equivalent circuit could readily be designed employing a negative logic convention.

The outputs of both the note selection 32 and the function selection input circuits 34 are connected to inputs 28 of encoding logic circuit 30 and are thus in parallel with one another. A substantial saving in cost and complexity is therefore achieved over other systems in which separate inputs must be provided for the function and note information. This saving is achieved by applying both the selected note and function input signals to inputs 28 on a time division multiplex basis.

The time division multiplexing is provided by circuitry including a clock 40, a binary counter (not shown) of encoding logic circuit 30 which is driven by clock 40 and an input multiplex enable circuit 42 responding to the binary counter of encoding logic circuit 30 to sequentially enable the input circuits. The input multiplex enable circuit 42 has a plurality of outputs 44 (illustrated by only a single line) respectively coupled to the plurality of input circuits 32, 34 and 36. Input enable signals are successively generated, one at a time, on the plurality of outputs 44. Only the one note selection or function input circuit which receives an enable signal is enabled to provide selection signals to inputs 28. The input enable signals are provided to the input circuits at a frequency on the order of magnitude of 250 hertz, and thus the maximum possible time between selection of a note on a keyboard or pedal clavier and transfer of that information to encoding logic 30 is negligible as compared with the duration of the playing of a note and the response time of the human ear.

The encoding logic circuit 30 scans all of the inputs 28, one at a time, during each input enable period, i.e., during operation of each input enable signal, and generates a memory enable pulse on an output line 31 each time a select signal is detected on one of inputs 28. During the scanning of each one of inputs 28, a binary code on outputs 33 (illustrated by only a single line) is generated representing that input. The memory enable output line 31 and the code select outputs 33 are connected to both note code memory 46 and function memory 48. When a memory enable pulse is generated during a note selection input enable period, a note code memory 46 stores the code corresponding to the note. During the function input enable periods the provision of a memory enable pulse line 31 causes the function memory 48 to store a representation of the function corresponding to the code on code select output line 33. Indications of the stored selected functions are provided to the special effects circuitry 38 on a plurality of outputs 50. One output 50 is provided for each of the functions capable of being performed by special effects circuitry 38.

The note codes stored in note code memory 46 are transferred to a tone selector 52 which, in response thereto, generates corresponding tone signals on its output 54. The tone signals on output 54 are selected from twelve tone signals 56 obtained from a tone generator circuit 58. The twelve tone signals have frequencies corresponding to the twelve notes of a musical scale.

The transfer of information from the note code memory to the tone selector 52 is by means of a note code select circuit 62 on a time division multiplex basis and under control of a note code multiplex enable circuit 64. The stored note codes are simultaneously provided on a plurality of outputs 47 to the note code select circuit 62. The note code multiplex enable circuit 64 sequentially generates, one at a time, note code enable pulses on a plurality of outputs 65 (illustrated as a single line) corresponding in number to the maximum number of note codes which can be stored in note code memory 46. Each note code enable output line 66 is associated with a corresponding one of the note code memory outputs 47. Each time an enable pulse is generated on one of the note code enable outputs 66, the note code of the memory output 47 associated therewith is selectively transferred to tone selector 52 on note code outputs 60 of note code select circuit 62. To minimize distortion, the note code enable pulses are generated at a frequency much greater than the highest frequency tone of the tone generating circuit 58. A frequency of 200 kilohertz has been found suitable for most applications. At this frequency, the note codes are transferred to tone selector circuit 52 in succession on outputs 60 at a frequency of 200 kilohertz. Consequently, the tone signals corresponding to the stored codes are sequentially selected and generated on tone output 54 at this multiplexing frequency.

These time division multiplexed tone signals are applied to a tone demultiplex circuit 66 which removes the note code enable multiplex frequency therefrom and simultaneously provides all selected tones on respective ones of a plurality of outputs 68 substantially in the same form as provided by tone generator 58.

This tone demultiplexing is achieved through control by the note code enable signals on outputs 66 from note code multiplex enable circuit 64.

An octave select circuit 67 selectively alters the frequency of the selected tone signals applied thereto according to the octave from which they were selected. The octave selection is indicated by the information carried by the fifth bit line of output lines 60.

It should be appreciated that another saving is realized by means of this time division multiplexing technique of selecting tone signals. But for this technique, a plurality of tone selectors would have to be provided for simultaneous generation of a plurality of tone signals.

Referring now to the detailed block diagram of FIGS. *3a*, *3b*, *3c* and *3d*, the illustrative waveforms of FIG. 4 and the schematic of the auto and manual function selection circuits 34 and 36 of FIG. 5, a more detailed description of the electronic organ will be given.

II. Input Circuits and Encoding Logic

Referring first to FIG. *3a*, the note selection input circuits 32 are seen to comprise three switch circuits 100, 102 and 104 which are respectively associated with two octaves of an accompaniment keyboard and an octave of the pedal clavier. The first octave switches $C_1$, C sharp$_1$, $D_1$, D sharp$_1$, $E_1$, $F_1$, F sharp$_1$, $G_1$G sharp$_1$, $A_1$, A sharp$_1$ and $B_1$, are respectively associated with the twelve keys of the first accompaniment manual octave. Clsoure of a key switch and thus selection of a note is effected when the organist depresses a key in the proper octave of the keyboard associated with the key switch. For example, when the organist presses down the C key of the lowest octave of the accompaniment manual keyboard, switch $C_1$ is closed. The key switches are momentary spring biased switches and are normally open and return to their open condition when their associated key is released. It should be understood that the selection of octaves for switch circuits 100, 102 and 104 is arbitrary and could easily be changed with more or less switch circuits provided as well.

The movable contacts of these twelve key switches are respectively coupled to the inputs 28 of encoding logic circuit 30, labeled I-1 through I-12. The fixed contact of each of the twelve key switches $C_1$ through $B_1$ are connected together in parallel through an enable bus 112.

Enable bus 112 is connected to an output IE-1′ from an OR gate 114 which, under control of the input multiplex enable generator 42, periodically provides a 1-state input enable signal thereto. During the first input enable period, closure of any one of the switches $C_1$ through $B_1$ results in provision of a 1-state input signal to its associated encoding logic input 28. For example, with switches $C_1$ and G sharp$_1$ closed, 1-state signals will be provided to inputs I-1 and I-9. When the first octave keyboard switch circuit 100 is not enabled, i.e., output IE-1′ of OR gate 114 is in a 0-state, it is disabled from providing any 1-state signal to encoding logic inputs 28.

The second octave keyboard switch circuit 102 and the pedal clavier switch circuit 104 are both identical to the first octave keyboard switch circuit 100 with the exception that they receive different enable inputs and manual inputs. Accordingly, these switch circuits are shown only in block form. The twelve switches of the second octave keyboard switch circuit 102 are respectively associated with the twelve keys of the second octave of the accompaniment manual keyboard. The twelve switches of the pedal clavier switch circuit 104 are respectively associated with twelve pedals of the pedal clavier octave. The enable bus of the second octave keyboard switch circuit 102 receives its enable signal from an output IE-2′ of an OR gate 116 controlled by input multiplex enable generator 42. The enable bus of the pedal clavier switch circuit 104 receives its enable signal from an input enable output IE-3 of input multiplex enable generator 42.

The octavely related switches of all note switch circuits 100, 102 and 104 are connected in parallel to the encoding logic inputs I-1 through I-12. For example, all of the C note key switches are connected to I-1, and all of the B note switches are connected to I-12. Each of the keyboard and pedal clavier switches is connected through an isolation diode 110 to prevent the application of an input enable signal from one of the circuits to another circuit through a closed switch in each.

Figure 5:
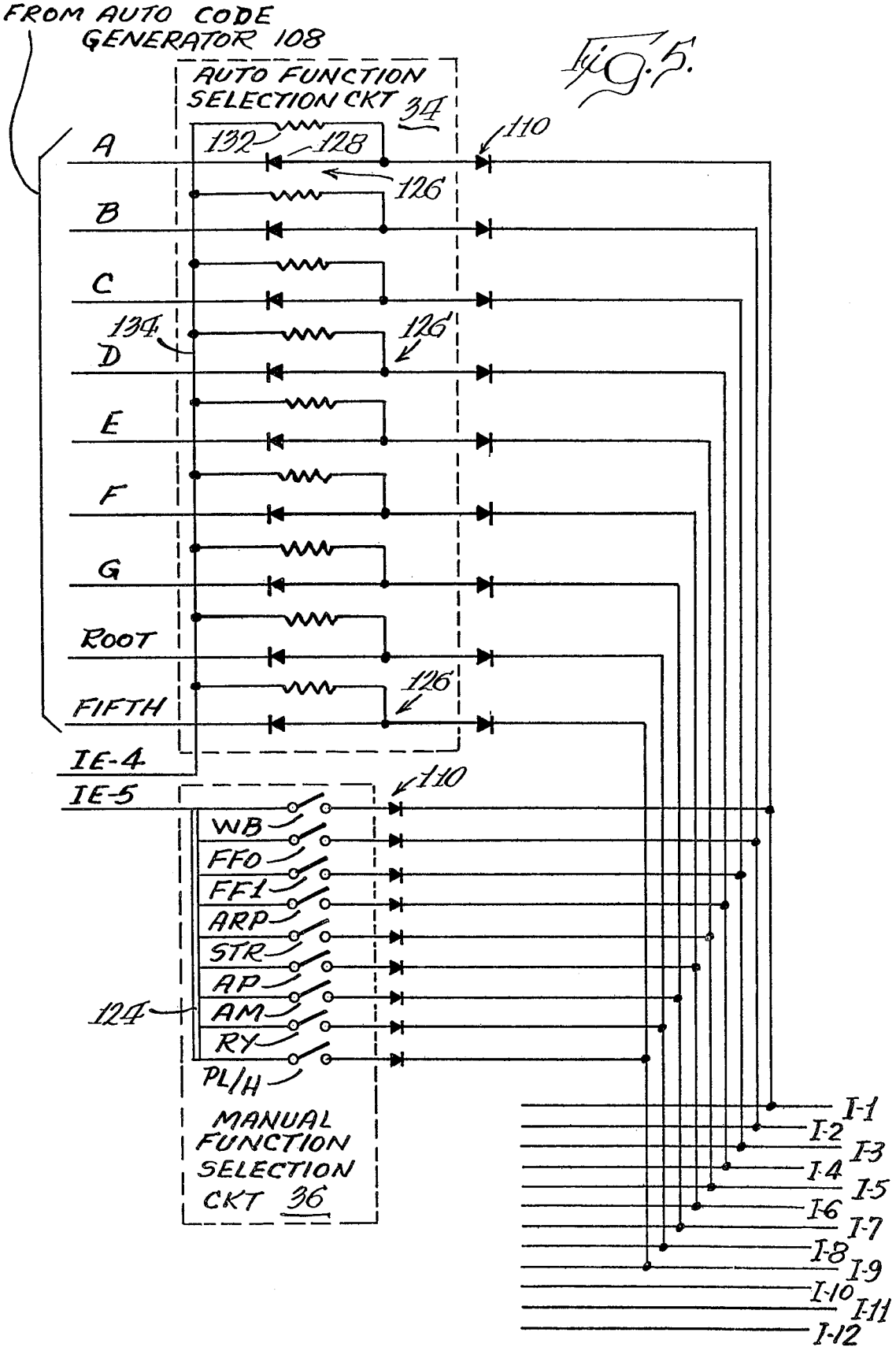
FIG. 5 is a schematic of circuitry corresponding to the auto function selection circuit and manual function selection circuit blocks of FIG. 3*a;*

Turning now to FIG. 5, the auto function selection circuit 34 is seen to have only nine inputs 106 from an auto code generator 108, and the manual function selection input circuit 36 is seen to have a set of only nine switches. The nine switches are respectively labeled WB, $FF_0$, $FF_1$, ARP, STR, AP, AM RY and PL/H, which labels are acronyms for the various functions capable of being performed by the special effects circuitry 38 or other like circuitry, such as accompaniment memory (AM), arpeggio (ARP), strum (STR), etc.

These function switches manually provide means for the organist to select a desired special effect or other function to be performed by the organ. The nine function selection switches of circuit 36 are respectively coupled to encoding logic inputs I-1 to I-9 through isolation diodes 110. Like the keynote switches, the function selection switches are connected in parallel to an enable bus 124. Enable bus 124 receives its input enable signal from an output IE-5 of input multiplex enable generator 42. Unlike the keynote switches, the function selection switches are not momentary switches so that the organist need not continue to depress the switches for the selected special effect to continue.

The auto function selection input circuit 34, unlike the other input circuits, does not have switches, but rather has nine identical input circuits 126 respectively connected to the nine function code inputs 106 from an auto code generator 108. The auto code generator 108 functions to generate 1-state and 0-state control signals on appropriate ones of its outputs "A", "B", "C", "D", "E", "F", "G", "ROOT" and "FIFTH". A part of the special effects circuitry is responsive to these control signals to automatically perform a special accompaniment function associated therewith. This function is performed, in part, through control of the pedal note circuitry which will be described in more detail hereinafter. This invention is not concerned with the specific function performed, the manner in which the code signals are generated, or the specific circuitry of any particular special effects circuit, and accordingly, the details of such circuitry are not described.

The input circuits 126 simulate manual switch closures to the encoding logic inputs 28 in response to the code signals from generator 108. Each input circuit 126 comprises a diode 128 with its cathode connected to its associated input and its anode connected to the anode of an associated output isolation diode 110. The junction between diode 128 and 110 of each input circuit 126 is connected through a resistor 132 to an enable bus 134 on which an enable signal on output IE-4 of input multiplex enable generator 42 is periodically provided. The nine input circuits 126 are respectively coupled to encoding logic inputs 28, I-1 through I-9, respectively, through the isolation diodes 110.

When a 1-state input enable signal is applied to enable bus 124, a 1-state signal is applied through the resistor 132 and diode 130 to the associated encoding logic inut 28 of each input circuit 126 that has its associated input 106 in a 1-state. If the associated input 106 is in a 0-state, the diode 128 is forward-biased, and a 0-state signal is applied to the associated encoding logic input 28. When the enable bus 134 is in a 0-state, i.e., when the auto function selection input circuit 34 is not enabled, 0-state signals appear at the cathodes of all the isolation diodes 130 regardless of the logic states of inputs 106.

Figure 4:
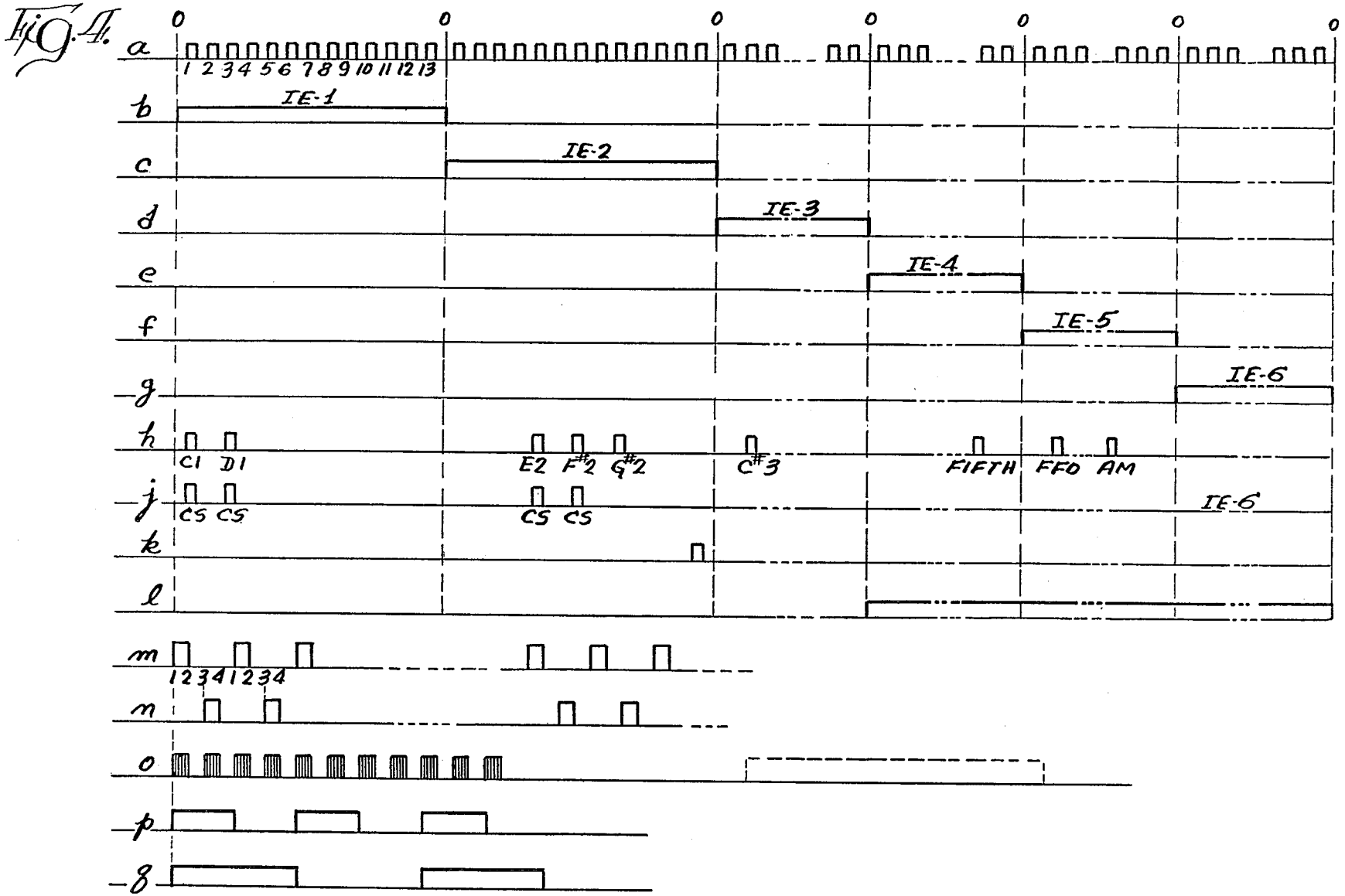
FIG. 4 is a comparative timing diagram of various signals developed in the electrical musical instrument of FIG. 1.

Referring now also to FIG. 4, the input multiplex enable generator 42 generates 1-state input enable pulses successively one at a time on its output IE-1, IE-2, IE-3, IE-4, IE-5 and IE-6, as illustrated in waveforms *b*, *c*, *d*, *e*, *f* and *g* of FIG. 4. Thus, encoding logic inputs 28 receive input signals from only one input selection circuit at a time with one exception. The exception is that during the input enable period when IE-6 is in a 1-state, both IE-1′ and IE-2′ are ina 1-state, and thus both the first and the second accompaniment octave keyboard switch circuit 100 and 102 are enabled. During this period, the encoding logic circuit 30 cannot distinguish whether a 1-state on one of its encoding logic inputs 28 is from a switch of circuit 100 or 102, or both. This enable input period is utilized by special effects circuitry which does not need to distinguish between first and second octaves to perform its specified function. This special effects circuitry does not form a part of the present invention, and this is not described in detail here. Except during this sixth input enable period, an enable pulse is generated on IE-1′ only during the period that an enable pulse is generated on IE-1 and an enable pulse is generated on IE-2′ only when a 1-state pulse is provided on input multiplex enable generator output IE-2.

The input multiplex enable generator 42 and the input circuits 32, 34 and 36 connected therewith provide a means for transferring the input information from each of the input circuits to the encoding logic inputs 28 on a time division multiplex basis. The time division multiplexing is on a circuit-by-circuit basis, with each input circuit having a plurality of outputs, rather than on a note-by-note basis, as in known systems. This together with the logic and memory circuits which will be described hereinafter, facilitates the time division multiplexing of note selection information together with function selection information, and reduces the number of needed wire connections and simplifies the logic circuitry. Most of the encoding and decoding logic serves a dual function of encoding both note and function information, as will appear hereinafter.

Figure 3A:
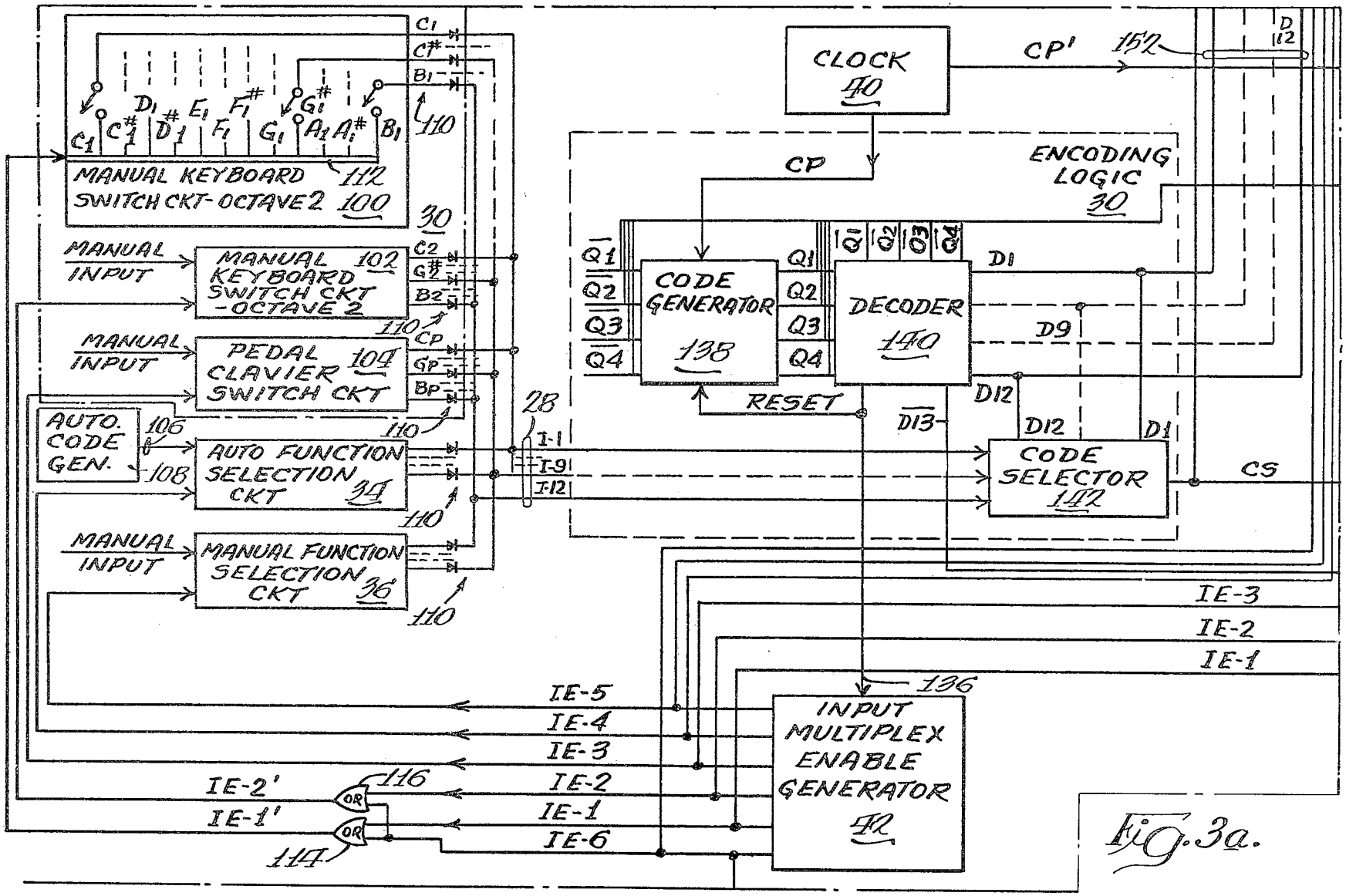
FIGS. 3*a*, *3b*, *3c* and 3*d* are the parts of another block diagram of the tone control circuit corresponding to, but having more detail than, the block diagram of FIG. 1; specifically, FIG. 3*a* corresponding to that part of the block diagram of FIG. 1 including the note and function input groups, the clock, the encoding logic, and the input multiplex enable functional blocks.

Referring to FIG. 3*a*, the input multiplex enable generator 42 is seen to be controlled by an input 136 from encoding logic circuit 30. Encoding logic circuit 30 includes a code generator 138, a decoder 140 and a code selector 142. Code generator 138 comprises a four-bit binary counter which counts high frequency clock pulses developed by a clock pulse generating circuit 40 on its output CP. This clock pulse signal, hereinafter referred to as clock pulse signal CP, is a periodic series of 1-state pulses, as illustrated in waveform "a" of FIG. 4. While other frequencies could be used, a frequency of 250 kilohertz for clock pulse signal CP has been found most suitable. Code generator 138 is a modulo thirteen counter, which means that it successively counts thriteen clock pulses and then is reset to a count of zero.

The count of code generator 138 is represented in binary form on four normal outputs Q1, Q2 Q3 and Q4, and on four inverted output Q1, Q2, Q3 and Q4 in customary fashion. For example, a count of 2 is represented by output Q2 being in a 1-state, and outputs Q1, Q3 and Q4 being in a 0-state. Each of the inverted outputs Q1 through Q4 are always in a state which is the inverse of the state of normal outputs Q1 through Q4, respectively.

The binary count of code generator 138 as represented by the various signals on its outputs is converted to a decimal form by decoder 140. Decoder 140 has twelve outputs D1 through D12, respectively associated with the first twelve counts of code generator 138. A 1-state pulse is generated on one of outputs D1 through D12, respectively, in response to binary counts of 1 through 12 of code generator 138. On a count of thirteen, a 0-state pulse is generated on an output D13 of decoder 140, which is coupled to the keynote memory control circuit 164, FIG. 3*c*, for purposes that will later become apparent. At the end of the thirteenth count, the decoder 140 generates another 0-state pulse on a reset output coupled to code generator 138. This 0-state pulse resets the code generator to a count of zero.

The reset output is also coupled to input 136 of input multiplex enable generator 42. Input multiplex enable generator 42 generates a 1-state enable pulse on one of its input enable outputs IE-1 through IE-6 successively in response to each reset pulse, as illustrated on waveforms a through g of FIG. 4. Thus, during each new complete cycle of operation of code generator 138, an input enable pulse is provided on a different one of outputs IE-1 through IE-6, and a different one of the input selection circuits is enabled.

Decoder outputs D1 through D12 and selection inputs I-1 through I-12, respectively associated therewith, are both connected with code selector 142. The code selector 142 scans inputs I-1 through I-12 in accordance with the decode pulses on outputs D1 through D12, and generates a 1-state code select pulse on its output CS for each input 28 which is in a 1-state when its associated decoder output is in a 1-state. Each code select pulse identified for storage or further decoding the binary number code being provided by code generator 138 when the code select pulse is generated. These marked codes are thus representative of the inputs 28 which are being provided with 1-state select signals by the input circuitry. Except as noted above, identity of the input enable period during which the code is marked uniquely identified the input circuit which provided the 1-state select signal to the encoding logic input corresponding to the marked code.

The above described encoding operation is further explained by way of example with reference to waveforms "a" through "h" of FIG. 4. With switches $C_1$ and $D_1$ of the first octave note selection circuit 100 closed, key switches $E_2$, F sharp$_2$ and $G_2$ of circuit 102 closed, pedal switch C sharp$_3$ of pedal clavier switch 104 closed, the input labeled FIFTH of auto function selection circuit 34 in a 1-state, and function switches $FF_0$ and AM of manual function selection circuit 36 closed, code select pulses would be generated during the time periods illustrated by waveform *g* of FIG. 4. As seen, during the first input enable period, i.e., the period of time that IE-1 is in a 1-state, a code select pulse is generated when decoder output D1 is in a 1-state and then again when decoder output D3 is in a 1-state. Likewise, during the second enable period, code select pulses would be generated successively when 1-state pulse decode enable pulses are generated on decoder outputs D5, D7 and D8. During the third enable period a code select pulse is generated when a decode enable pulse is generated on output D2. During the fourth enable period a code select pulse is generated when a decode enable pulse is generated on output D9. During the fifth input enable period, a code select pulse is generated when a decode enable pulse is generated on output D2 and later when one is generated on output D7. As can be seen by reference to waveform a, each code select pulse is unique to a particular count of code generator 138.

The code select pulses provide an indication to the note code memory circuit 46 to store the code or count in code generator 138 during the first three input enable periods. Output CS is also connected to the function memory 48, FIG. 3*b*, to provide an indication thereto to store the code of code generator 138 of the selected function during the fourth and fifth input enable periods. During the sixth input enable period, the code select pulses may provide a like function for special effects circuitry associated with input multiplex enable generator output IE-6.

III. Memory and Tone Selection Circuits

Figure 3B:
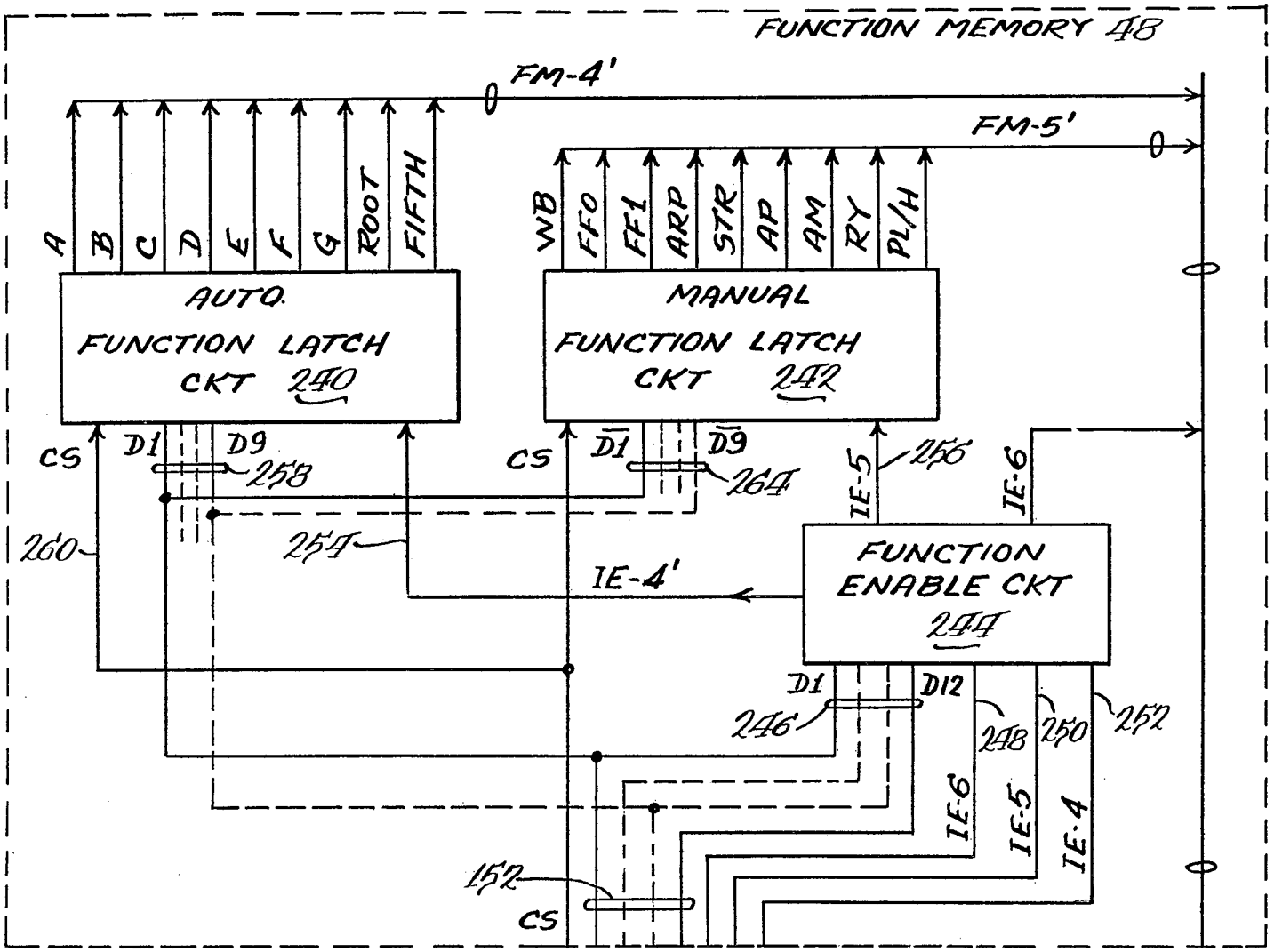
FIG. 3*b* corresponding to the function memory block.
Figure 3C:
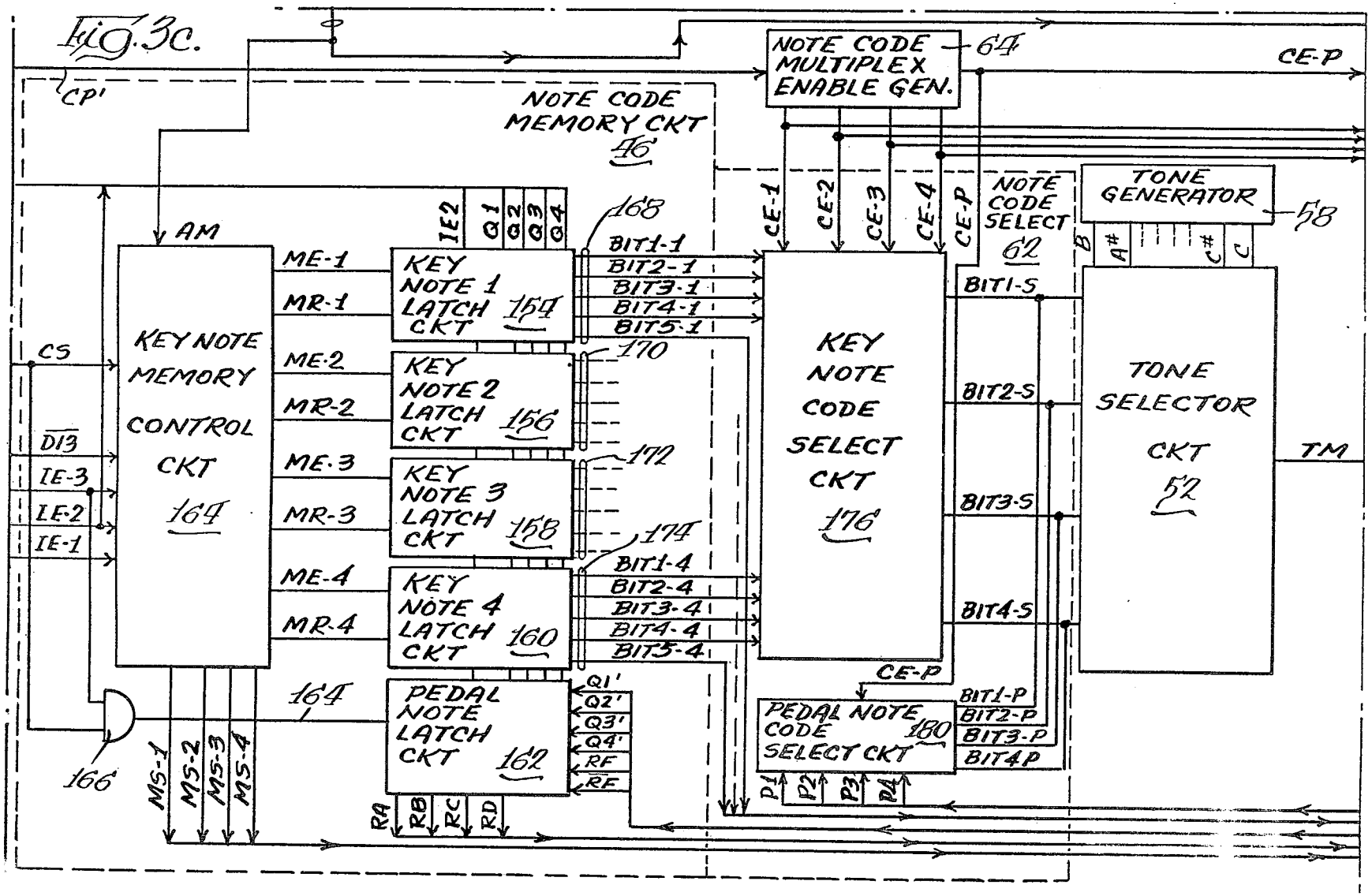
FIG. 3*c* corresponding to that part of FIG. 1 including the note code memory, note code multiplex enable, note code select, tone selector and tone generator blocks.
Figure 3D:
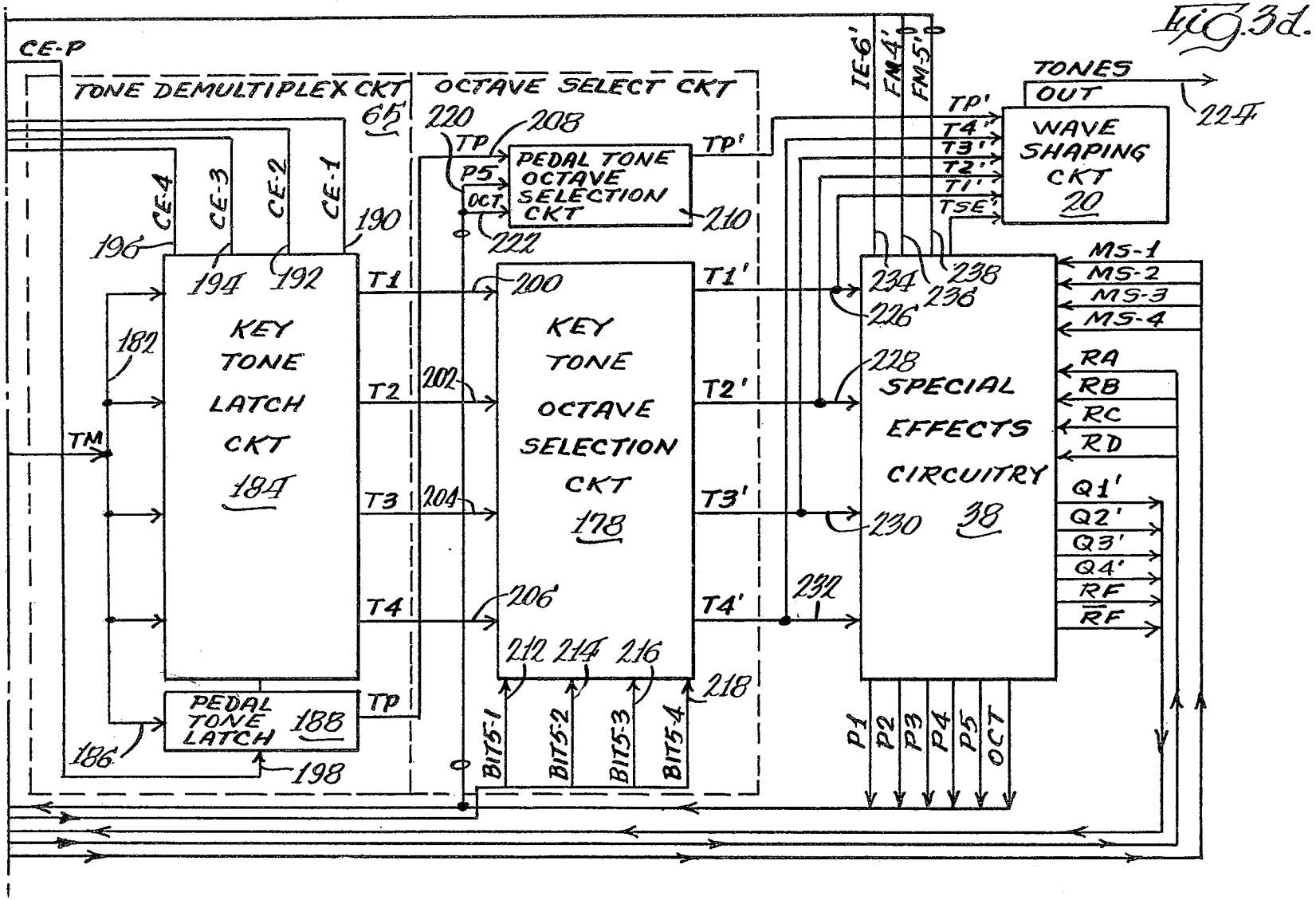
FIG. 3*d* corresponding to that part of FIG. 1 including the tone demuliplex, the octave select, the special effects and the wave shaping blocks.

Turning to FIG. 3c, the operation of the note code memory circuit 46 will first be described. The note code memory 46 includes four keynote latch circuits 154, 156, 158 and 160, and a pedal note latch circuit 162. The four keynote latch circuits 154 through 160 are controlled by a keynote memory control circuit 164. The pedal note latch 162 is controlled by the output 164 of a NAND gate 166 and also by signals provided on outputs Q1′-Q4′, RF and RF from special effects circuitry 38, FIG. 3d. The keynote memory control 164 is responsive to code selector output CS, decoder output D-13 and the input multiplex enable generator outputs IE-1, IE-2 and IE-3 to perform its control function. The NAND gate 166 is responsive to the signals developed on outputs CS and IE-3 to perform its control function. All of the keynote latch circuits are controlled to store the signals provided on the code generator 138 outputs Q1-Q4 and the input multiplex enable generator output IE-2 connected therewith. The pedal note latch is alternately controlled to store the signals developed on outputs Q1′, Q2′, Q3′ and Q4′ from the special effects circuitry 38.

The keynote memory control 164 controls keynote latches 154-160 by means of signals provided on its output ME-1 and MR-1, ME-2 and MR-2, ME-3 and MR-3, and ME-4 and MR-4, respectively connected therewith. Memory enable outputs ME-1 through ME-4, when switched to 1-state, enable the keynote latch circuits associated therewith to store a five-bit note code. The first four bits of the code are provided by the outputs of code generator 138 and designate the note and the fifth bit of the code is provided on output IE-2 and designates the octave of the note. The memory reset outputs MR-1 through MR-4, when switched to a 0-state, reset or clear the associated keynote latches of any codes stored therein.

The keynote memory control 164 generates 1-state memory enable pulses on outputs ME-1 through ME-4 in succession, one at a time, in response to the first four code select pulses occurring during the first two enable periods. The one keynote latch circuit which is enabled when the code select pulse is generated stores the five-bit binary code being provided at the time of the code select pulse. Selection inputs 28 are scanned from input I-1 connected to the lowest note key switch to I-12 connected to the highest note key switch, and the first octave manual keyboard switches are scanned before the second octave manual keyboard switches. Accordingly, only the codes for the four lowest selected notes of the two octaves of the accompaniment manual keyboard will be stored in keynote latches 154 through 160. It will be readily understood that more note codes could be stored if additional keynote latches and associated circuitry were provided.

After the fourth latch is loaded with a note code, no further memory enable pulses are generated until the next scanning cycle and, thus, if five keys on the accompaniment keyboard are simultaneously held down, only the codes of the lowest four notes will be stored. For example, referring to waveform *j* which indicates the timing of memory enable pulses on outputs ME-1 through ME-4 as generated in response to the code select code pulses shown in waveform *h* of FIG. 4, it is seen that memory enable pulses are generated on ME-1 through ME-4 in succession respectively in response to the code select pulses for notes C1 and D1 of the first octave and notes E2 and F sharp 2 of the second octave, while a memory enable pulse is not generated in response to the code select pulse for note G sharp 2 of the second octave.

The keynote memory control 164 also controls the resetting or clearing of keynote latches 154 through 160 by means of 0-state reset signals generated on outputs MR-1 through MR-4, respectively connected thereto. The keynote memory control 164 has two modes of operation, the memory mode and non-memory mode, with respect to memory reset pulse generation depending upon the logic state of an accompaniment memory function latch 242 output Am from function memory 48, FIG. 3*b*, connected therewith. The organist manually controls the state of the accompaniment memory function latch 242 and thus the mode of operation of the memory control circuit 164 by means of the accompaniment memory selection switch, AM, of manual function selection circuit 36.

The operation of two embodiments of the memory control circuit, respectively shown in FIGS. 6*b*, 8, 8*a* and 8*b*, will be described in detail hereinafter. The two embodiments primarily differ in operation when in the accompaniment memory mode which is the mode of operation resulting with output AM in a 1-state. The memory mode of operation in both embodiments permits a player to select up to four notes to continue to be played after the associated keys have been released, freeing one hand to play the solo keyboard in both embodiments while the notes selected on the accompaniment manual continue to be sounded. Briefly, in the embodiment shown in FIG. 6b, means are provided while in the memory mode to prevent resetting of the keynote latches until all of the keys which resulted in storage of the notes have been released and a new key is thereafter depressed. In the embodiment shown in FIG. 8, the latches may be selectively reloaded with new notes and information without the necessity of first releasing all of the keys. This is of great value to the organist and allows him greater flexibility than has been heretofore available.

In the non-memory mode, with output AM in a 0-state, each keynote latch is reset at the beginning of each memory enable pulse provided thereto. All of those keynote latches which have not received a memory enable pulse, indicating the player has released the key corresponding thereto, are reset in response to the 0-state pulse generated on output D13 of decoder 140 during the second input enable period. Thus, if no code select pulses are generated, reset pulses are provided to all keynote latch circuits at the end of the second input enable period. Likewise, if only one code select pulse is generated during the first and second enable period, only keynote latch circuits 156, 158 and 160 are reset. If two code select pulses are generated, keynote latch circuits 158 and 160 are reset and, if three code select pulses are generated, only keynote latch 160 is reset. If four or more code select pulses are generated, no memory reset pulses are generated, and the note codes remained stored in all of the keynote latches throughout all of the remaining input enable periods. This, in some instances, is necessary for the special effects circuitry 38 to perform certain functions.

As stated, the note code memory 46 also includes a pedal note latch circuit 162 which is controlled separately from the keynote latches in part by an AND gate 166. AND gate 166 has one input connected to input multiplex generator output IE-3 and another input connected to the code selector output CS. Customarily only one pedal is depressed at a time. Thus, only one pedal note latch is provided to store the code of the one pedal note which is selected. When a code select pulse occurs during the third input enable period, both inputs to AND gate 166 are in a 1-state and a 1-state memory enable pulse is generated on output 164.

The pedal note latch circuit 162 is alternately used in conjunction with special effects circuitry 38. Accordingly, the pedal note latch 162 receives alternate code inputs Q1′, Q2′, Q3′ and Q4′, and reset control signals RF and $\overline{RF}$ from special effects circuitry 38 in addition to signals from the code generator counter outputs Q1 through Q4. Depending upon the states of inputs RF and $\overline{RF}$, the pedal note latch 162 stores the four-bit code being presented on code generator counter outputs Q1 through Q4 or special effects circuit outputs Q1′ through Q4′.

The note code select circuit 62 includes a keynote code select circuit 176 and a pedal note code select circuit 180. The keynote code select circuit 176 is controlled by signals provided on outputs CE-1, CE-2, CE-3 and CE-4 of note code multiplex enable generator 64, and the pedal note code select circuit 180 is controlled by signals provided on an output CE-P from note multiplex enable generator 64 to transfer, on a time division multiplex basis, the first four bits of each stored note code to a tone selector circuit 52. Each of the keynote latches has five outputs respectively labeled bit-1 through bit 5, collectively designated by reference numerals 168, 170, 172 and 174, respectively. The note code signals on bit-1 through bit 4 of all keynote latches are simultaneously provided to the tone selector circuit. The bit 5 code output of each of keynote latch outputs 168, 170, 172 and 174 are connected to a key tone octave selection circuit 178 of octave select circuit 67, FIG. 3*d*.

The pedal note latch 162, because of adaption for use with special effects circuitry 38, as previously discussed, provides a 4-bit pedal note code on outputs RA, RB, RC and RD to special effects circuitry 38. Special effects circuitry 38, in turn, provides note code information to the pedal note code select circuit 180 of note code select circuit 52 on outputs P1, P2, P3 and P4. In the absence of use of the pedal note latch 162 by the special effects circuitry 38, the outputs P1 through P4 applied to pedal note code select circuit 180 respectively correspond to the binary states of Q1 through Q4 stored in pedal note latch 162 in response to the code select pulses occurring during the third input enable period.

Note code multiplex enable generator 64 successively generates 1-state code enable pulses CE-1 through CE-4 and CE-P on its five outputs one at a time at a frequency determined by a clock pulse output signal on an output CP' from clock 40. To ensure that the code stored in each of the note latches will be transferred to tone selector 52 during the period of storage therein, the note code multiplex enable pulses are generated at a greater frequency than the frequency at which input multiplex enable pulses are generated by input multiplex enable generator 42. The clock pulse frequency of 1 MHz on output CP' for a frequency of 250 KHz on output CP has been found suitable.

The keynote code select circuit 176 has only four outputs, respectively labeled bit 1-S through bit 4-S, on which all of the note codes are transferred to the tone selector 152. The first four bits of the keynote codes stored in latches 154, 156, 158 and 160 are developed in succession on outputs bit 1-S through bit 4-S, respectively, in response to 1-state code multiplex enable pulses on inputs CE-1, CE-2, CE-3, CE-4. Likewise the first four bits of the pedal note code stored in pedal note latch 162 are developed on outputs bit 1-P through bit 4-P in response to a 1-state code multiplex enable pulse on input CE-P.

The manner in which the note codes are transferred to the tone selector 52 is illustrated by waveforms *l*, *m* and *n*. Waveform m illustrates the signal on one of the outputs of keynote code selector circuit 176 developed in respose to enable pulses on CE-1 when the associated one of outputs 168 of keynote latch circuit 154 is in a logic 1-state. Waveform n illustrates the signal on one of the outputs of keynote code select circuit 176 generated in response to enable pulses on CE-3 when the associated one of outputs 172 of keynote latch circuit 158 is in a 1-state. Note code multiplex enable generator 64 generates note code enable pulses continuously. Thus, a 1-state code bit will result in development of 1-state pulses on the corresponding output of keynote code select circuit 176 during development of note code multiplex enable pulses on outputs CE-1 through CE-4 and CE-P from initiation of storage in a keynote latch until the latch is reset. If a stored code bit is a binary logic zero, no pulses are generate on the corresponding output of keynote code select circuit 176.

Tone selector circuit 52, during each code enable period, selects from the twelve tone signals provided by tone generator 58 the tone signal corresponding to the note code presented during that period and generates a 1-state tone signal pulse on its output TM. Tone signal pulses are generated on output TM in response to presentation of the binary code corresponding thereto only during those periods of time when the tone signal is also in a logic 1-state, as illustrated in waveform o thus tone signal pulses are illustrated for the multiplex enable pulses shown in waveform m and n. The tone signal pulses for all five selected tones are of course all multiplexed together on output TM. Waveform o illustrates the waveform which would result if only one note latch contained a note code.

IV. Tone Latch and Special Effects Circuits

Turning now to FIG. 3*c* output TP is connected to an input bus 182 of a key tone latch 184 and to an input 186 of a pedal tone latch 188 which together comprise the tone demultiplex circuit 66. Demultiplexing by the key tone latch circuit 184 is achieved through response to signals at inputs 190, 192, 194 and 196 thereof respectively provided by note code multiplex enable generator outputs CE-1, CE-2, CE-3 and CE-4. Demultiplexing by the pedal tone latch circuit 188 is achieved through response to the enable signals at an input 198 thereof provided by the note code multiplex enable generator output CE-P. The tone demultiplex circuit 66 separates the tone pulse signals from all five of the signals appearing on output TP and simultaneously provides them on outputs T-1, T-2, T-3, T-4 and T-P, respectively. The tone signals on outputs T-1 through T-4 are those respectively selected in accordance with the binary note codes stored in keynote latches 154-160. The tone signals on output T-P of pedal tone latch 188 is the one selected in accordance with the note code stored in pedal note latch 162. Referring again to waveform o of FIG. 4, it is seen that during the logic 1-state of the tone signal, the output signal on TM for a single selected tone comprises a rectangular wave train of high frequency pulse groups. The frequency of the pulses forming each pulse group is the tone signal frequency. The frequency at which the pulse groups are generated is dependent upon the frequency at which the note code multiplex enable generator 64 generates the code enable pulses.

The tone demultiplex circuit 66, in addition to demultiplexing or separating the different tone pulse signals according to the five selected tones, also removes the high frequency multiplexing signals imposed thereon. The tones generated on the outputs of the tone demultiplex circuit 65 are substantially identical to the tone signals provided by tone generator 58 with the exception that the tone signals 1-state pulse may be shortened by a slight amount. This shortening occurs whenever the tone signal switches to a 1-state during a period of time that the latch corresponding thereto is not being scanned, as illustrated by waveforms P and Q. Thus, this amount can be no greater than the time period between successive multiplex enable pulses. With a tone signal frequency of 1,000 Hz and an note code multiplex enable pulse frequency of 50 KHz, the shortening of the tone signal is no greater than 2%, which amount has been found to be undetectible in the resulting audible output. The use of higher frequencies for multiplexing can of course reduce the distortion even further.

The demultiplexed tone signals on outputs T-1 through T-4 and T-P are applied to the octave select circuit 67 which selectively reduces the frequencies thereof in accordance with the fifth bit of the note codes corresponding thereto and provides the octave selected tone signals on outputs T-1', - T-4' and T-P', respectively. The octave select circuit 67 includes a key tone octave selection circuit 178 and a pedal tone octave selection circuit 210. The demultiplexed key tones on outputs T1 through T4 are received at tone signal inputs 200, 202, 204 and 206 of key tone octave selection circuit 178 and the demultiplexed tone on output TP of pedal tone latch 188 is received at an input 208 of a pedal note octave selection circuit 210. The key tone octave selection circuit 178 also has octave information inputs 212, 214, 216 and 218 for respectively receiving the bit 5 outputs of keynote latch circuits 154, 156, 158 and 160. The signals on inputs 212, 214, 216 and 218 respectively determine the octave selection of the demultiplexed tone signals at inputs 200,

202, 204 and 206. If the 4-bit code corresponding to a demultiplexed tone signal is selected for storage during the first input enable period, a logic 0 is stored in the bit 5 location of the latch. If the note code is selected for storage during the second input enable period, a 1-state signal is entered into the fifth bit location of the latches. The key tone octave selection circuit 178 in response to a 0-state at its bit octave information input divides the demultiplexed tone signal at its tone signal input and provides an octave selected tone signal on its output having a frequency equal to half the frequency of the demultiplexed tone signal applied to its input. If, on the other hand, the bit-5 output from the latch associated with the demultiplexed tone signal is in a 1-state, no division occurs and the octave selected tone signal provided at the output has the same frequency as the input tone signal. The pedal tone octave selection circuit 210 is similarly controlled in accordance with signals applied to inputs 220 and 222, on outputs P5 and OCT from special effects circuitry 38. A 0-state signal at either one of the inputs 220 and 222 reduces the output frequency to one-half of the input tone frequency while 0-state signals at both inputs reduces the output tone frequency to one-fourth the input tone frequency.

The five octave selected tone signals are all connected to wave shaping circuit 20 which provides the appropriate wave shaping thereto to achieve the desired timbre, etc., and are then applied to a suitable speaker system (not shown) for conversion to audible sound.

The octave selected tone signals on outputs T-1′, T-2′, T-3′ and T-4′ are also connected to inputs 226, 228, 230 and 232 of special effects circuitry 38. Special effects circuitry 38 operates on the octave selected key tone signal in accordance with signals respectively applied to an input 234, a plurality of inputs 236 and a plurality of inputs 238 from outputs IE-6′, FM-4′ and FM-5′ of function memory circuit 48.

V. Function Memory Circuit

Referring to FIG. 3*b*, function memory circuit 48 includes an auto function latch circuit 240 which provides function signals on outputs FM-4′, a manual function latch circuit 242 which provides function signals on outputs FM-5′, and a function enable circuit 244 providing control signals for entry of data into the latches. Each of function latch circuits 240 and 242 has nine 1 -bit storage elements or latches for respectively storing the nine functions selectable at their associated function selection input circuits. The function selection input information is transferred to the function latches on a time division multiplex basis by employing part of the same circuitry used to transfer the note selection information to the note latches, thus allowing great efficiency in circuit design.

The function enable circuit 244 has twelve inputs 246 respectively connected to outputs D1 through D12 of decoder circuit 140 and three inputs 248, 250 and 252, respectively coupled to outputs IE-6, IE-5 and IE-4 of input multiplex enable generator 42. In response to signals at these inputs, the function enable circuit 244 generates function code enable pulses on three outputs thereof, IE-4′, IE-5′ and IE-6′. Output IE-6′ is connected to special effects circuitry 38 which is controlled in accordnce with signals thereon. The function code enable pulses developed on outputs IE-4′ and IE-5′ respectively enable auto function latch circuit 240 and manual function latch circuit 242 to respond to function selection information.

Specifically, auto function latch circuit 240 also has nine inputs 258 respectively for receiving decode pulses from decoder outputs D1 through D9 and an input 260 coupled with code selector output CS. The nine 1-bit function codes on outputs FM-4′ are respectively associated with the nine input circuits 126 of auto function selection input circuit 34 (FIG. 5) bearing the same labels. If a 1-state signal is provided on the output of one of the auto function selection input circuits 126 during the fourth input enable period, 1-state pulses are simultaneously provided at inputs 260 and 254 and at the associated inputs 258. The auto function latch circuit 240 in response thereto stores the selection by means of the 1-bit latch associated with the output corresponding to the selected function. For example, if a 1-state is provided from the input circuit 126 labeled "FIFTH", a logic-1 is entered into the 1-bit latch associated with the output FM-4′ of auto function latch circuit 240 labeled "FIFTH".

Manual function latch circuit 242 operates in an identical fashion as the auto function latch circuit 240 and generates function selection signals on nine outputs FM-5′ respectively corresponding to function selection switches 36 bearing the same label. If a particular function switch is closed, such as switch WB, the latch of output WB is set in a 1-state condition during the fifth input enable period. The selected latch assumes its 1-state condition in response to a code select pulse at its input 262 occurring simultaneously with a pulse on input 256 and a decode pulse occurring on the corresponding one of nine inputs 264 respectively associated with outputs D1 through D9 of decoder 140.

The selected latches of both auto function latch circuit 240 and manual function latch circuit 242 remain in their latched state so long as a code select pulse is generated on their respective inputs 260 and 262 during occurrence of a decode pulse on the appropriate one of their respective inputs 258 and 264. The code select pulse continues to be generated at the proper time so long as the switch of manual function selection circuit 36 corresponding thereto remains closed or the input 106 of auto function selection circuit 34 corresponding thereto remains in a 1-state. Upon occurrence of a decode pulse on the corresponding one of the inputs 258 or 264 and in the absence of a code select pulse, the selected latch is cleared or reset and function select indications are removed from the associated function memory output.

Turning now to FIGS. 6*a*, 6*b*, 6*c*, 6*d* and FIGS. 7*a*, 7*b* and 7*c*, the operation of specific circuit embodiments of the various circuits shown in block form in FIGS. 3*a*–3*d* will be described.

VI. Input Multiplexing and Encoding Logic Details

Figure 6A:
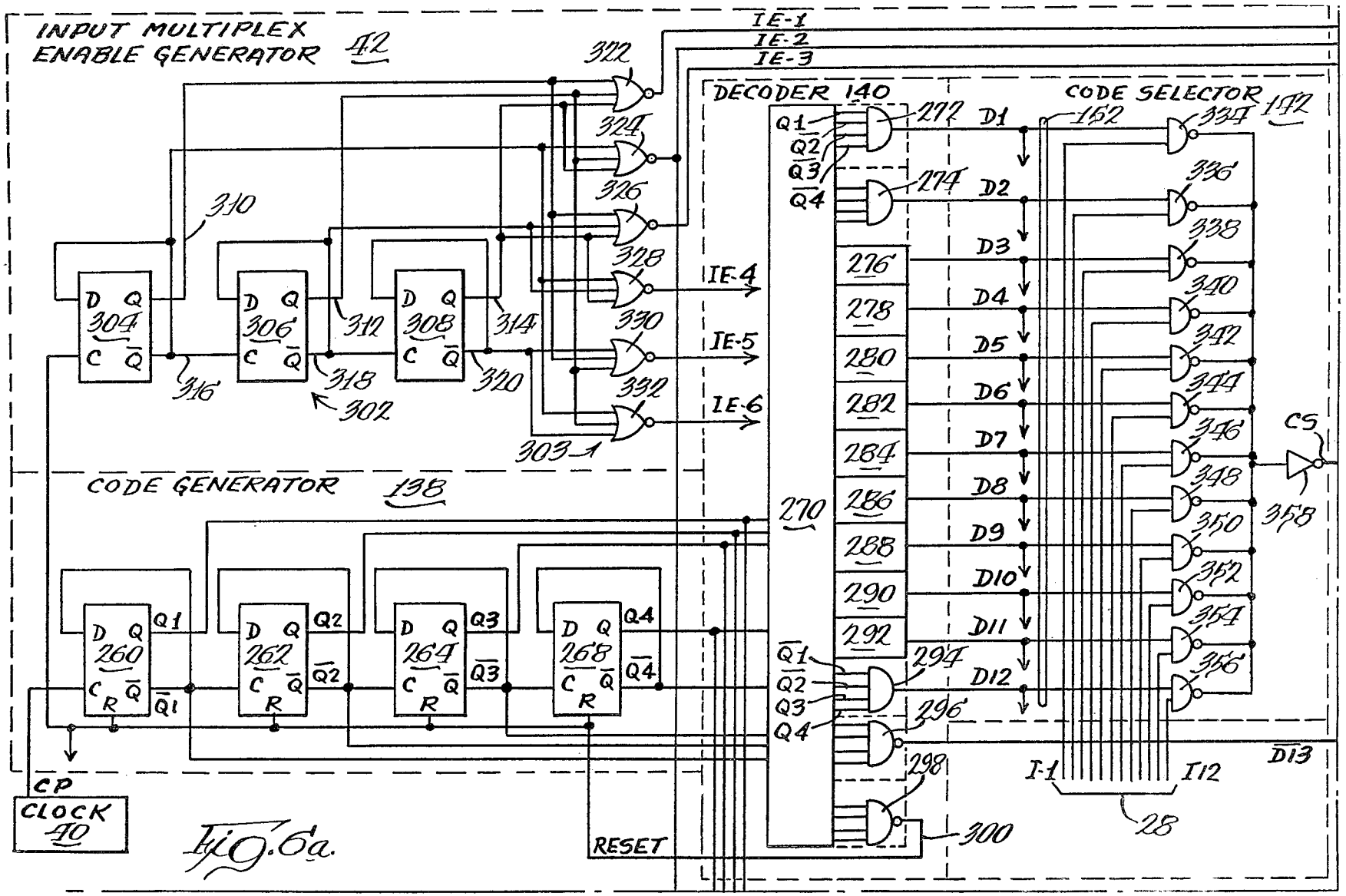
FIG. 6*a* is a circuit logic diagram of the code generator, decoder, code selector and input multiplex enable generator of FIG. 3*a;*

The preferred form of the input multiplex enable generator 42 and the code generator 138, decoder 140 and code selector of the encoding logic circuit 30 is shown in FIG. 6*a*. Both input multiplex enable generator 42 and code generator 138 are seen to comprise binary counters. Code generator 138 comprises four bistable multivibrators or flip-flops 260, 262, 264 and 268 connected together in customary fashion to form a four-stage binary counter. Each of the flip-flops has a clock input labeled "C", a respective normal output Q1, Q2, Q3 and Q4 and an inverted output $\overline{Q1}$, $\overline{Q2}$, $\overline{Q3}$ and $\overline{Q4}$, respectively. The first stage of the counter, flip-flop 260, has its clock input C connected to output CP of clock 40 and is driven by the high frequency clock signals therefrom.

All of the counter outputs are connected to a counter output bus 270 from which are taken inputs to twelve AND gates 272, 274, 276, 278, 280, 282, 284, 286, 288, 290, 292 and 294. These twelve AND gates have the appropriate code generator outputs connected thereto to respectively decode binary counts of one through twelve, respectively. For instance, the first AND gate 272 has four inputs respectively coupled to Q1, $\overline{Q2}$, $\overline{Q3}$ and $\overline{Q4}$. When the binary counter has a binary count of one, all of these inputs are in a 1-state and a 1-state pulse is generated on the output of AND gate 272. Likewise, for instance, AND gate 294 has four inputs respectively connected to code generator output Q1, Q2, Q3 and Q4. At a binary count of 12, all of these inputs are in a 1-state and a 1-state pulse is generated on the output of AND gate 294. The remaining gates, shown only in block form, are connected to code generator outputs in a similar fashion.

The decoder output $\overline{D13}$ is taken from the output of a NAND gate 296 which is connected to appropriate code generator counter outputs to decode a binary count of thirteen. Unlike the twelve AND gates, NAND gate generates a 0-state pulse on its output $\overline{D13}$ when the code generator counter 138 reaches the count of thirteen.

The reset pulse is likewise generated by a NAND gate 298 which is connected to the code generator output to decode a count of fourteen. When a count of fourteen is reached, NAND gate 298 generates a 0-state reset pulse on its output 300 which is connected to a reset input R of each of flip-flops 260, 262, 264 and 268. The negative going transition of this 0-state pulse causes all of the code generator counter fliip-flops to reset to a zero count. Upon the occurrence of the next clock pulse from clock 40, the counter again advances to a count of one and the cycle is repeated.

The input multiplex generator 42 comprises a binary counter 302 and a decoder 303 for converting the binary counts thereof to a decimal representation on the input enable outputs IE-1 through IE-6. Binary counter 302 is formed from three flip-flops 304, 306 and 308, each having clock outputs c, normal outputs Q and inverted outputs $\overline{Q}$ and being connected together in customary binary counter fashion. The clock input C of the first storage flip-flop 304 is connected with the output 300 of reset NAND gate 298. Thus, counter 302 is advanced by one count each time the code generator counter reaches a count of fourteen.

The respective normal outputs 310, 312 and 314 and the respective inverted outputs 316, 318 and 320 of flip-flops 304, 306 and 308 are appropriately connected to NOR gates 322, 324, 326, 328, 330 and 332 of decoder 303. These NOR gates respectively decode binary counts of zero, one, two, three, four and five. For example, on a zero count of binary counter 302, all of the inputs to NOR gate 322 are in a 0-state, and a 1-state input enable pulse is generated on the IE-1 output thereof. The outputs of NOR gates 324, 326, 328, 330 and 332 provide input enable pulses on outputs IE-2, IE-3, IE-4, IE-5 and IE-6 in a similar fashion. Thus, it is seen that during provision of each input enable pulse, the code generator counter 138 completes one scanning cycle. The counter 302 completes a cycle of operation for every eight reset pulses. At the end of each cycle, the counter returns to a count of zero and a new cycle is begun. Provision could be made to have a reset counter reset to zero after a count of six in the manner that code generator counter 138 is reset, but such a provision is not necessary for successful operation.

The code selector 142 includes twelve NAND gates 334, 336, 338, 340, 342, 344, 346, 348, 350, 352, 354 and 356. Each NAND gate has two inputs. The first inputs of the twelve NAND gates 334-356 are respectively coupled to the outputs of the twelve AND gates 272-294 of decoder 140. The twelve second inputs are respectively coupled to the twelve encoding logic inputs 28, I-1 through I-12, respectively. The code selector also includes an inverter 358 having an input to which all of the NAND gate outputs are connected. The output of inverter 358 is the code selector output CS. Each of the code selector NAND gates operates a 0-state pulse whenever 1-state signals are applied to both of its inputs. These 0-state pulses are inverted to 1-state code select pulses by inverter 358.

The operation of the encoding logic circuit and the input multiplex enable circuit can be best understood by example. Presuming initially that the input multiplex enable counter 302 has a count of zero, an input enable signal is provided on the output IE-1 of NOR gate 322 and the signal applied to encoding logic inputs 28 are taken from the first octave keyboard switches 100. At a count of one of code generator 138, a 1-state pulse is applied to first input of NAND gate 334 by AND gate 272 which is enabled thereby to respond to a 1-state signal on encoding logic input I-1. If key switch $C_1$ is closed, a 1-state signal is provided to the second input of NAND gate 334, and the output thereof switches to a 0-state. The 0-state is inverted by inverter 358 and a 1-state code select pulse appears on output CS. On the other hand, if the switch $C_1$ is open, the second input to NAND gate 334 will be in a 0-state at a binary count of one, and the output of NAND gate 334 will remain in a 1-state. Inverter 358 will therefore not generate a code select pulse. NAND gates 334–356 are successively enabled to respond to signals from encoding logic inputs I-2 through I-12 as the code generator counts from two through twelve. Thus, during the first input enable period, code select pulses are generated during each count corresponding to a key switch of the first octave that is closed. As stated, at a count of thirteen, a 0-state pulse is generated on output $\overline{D13}$. At the end of that pulse, code generator counter 138 is reset to a count of zero, and input multiplex generator counter 302 is advanced by one count.

With input multiplex generator counter 302 storing a binary-1 count, a 1-state enable pulse is provided on output IE-2 of NOR gate 324. The input signals to encoding logic inputs 28 are then provided by the second octave keyboard switches. Code generator 138 again advances through twelve counts of clock pulses from clock 40, decoder 140 successively enables NAND gates 334–356 of code selector 142, and code select pulses are generated for each of the second octave keynote switches being held in a closed position. This process is repeated during each of the input enable periods including function input enable periods. During the fourth and fifth input enable periods, the code select pulses identify the function codes rather than note codes. If input multiplex generator counter 302, however, is permitted to count through the count of seven, none of the input circuits are enabled, and no code select pulses are generated.

VII. Keynote Memory Logic Details

Figure 6B:
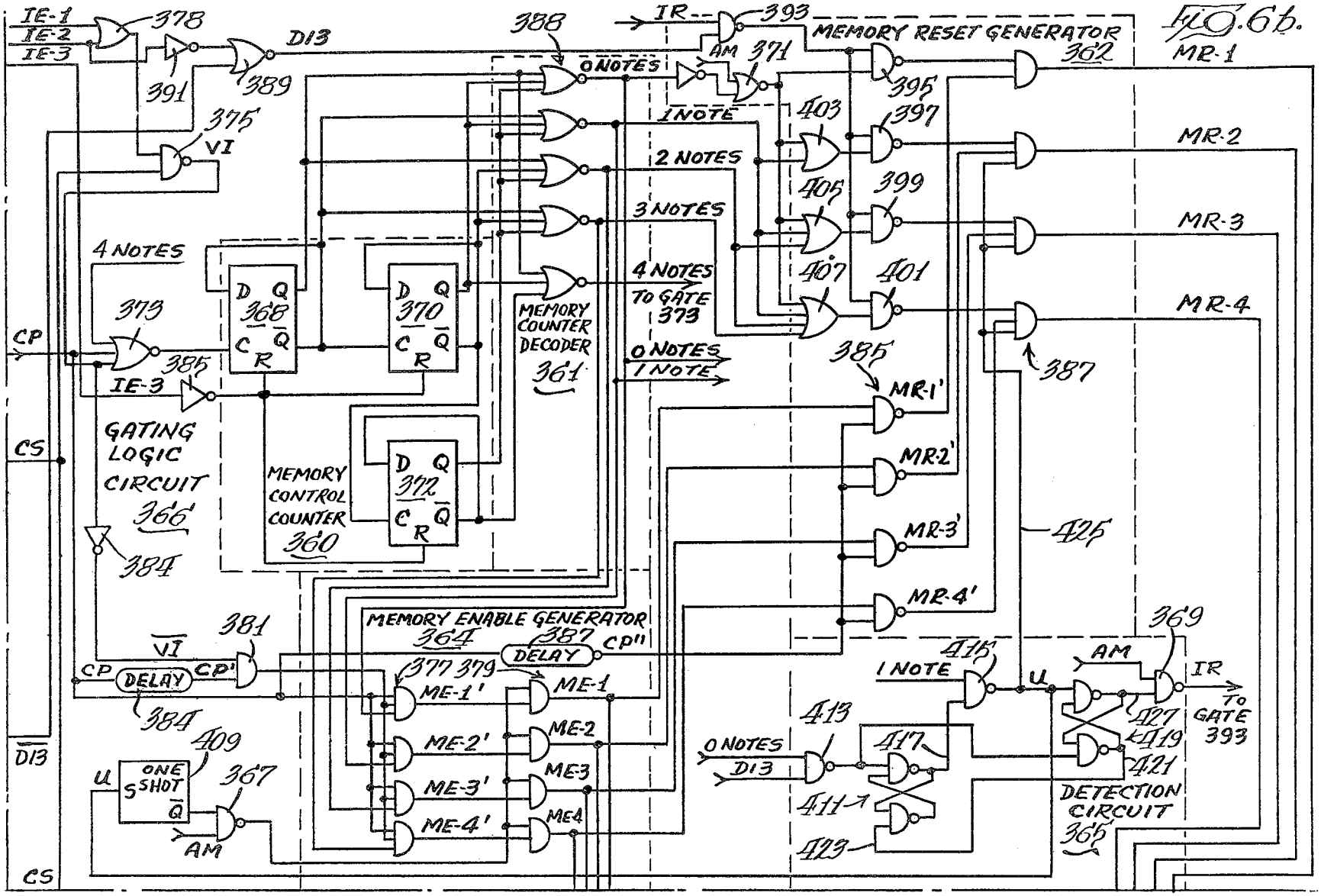
FIG. 6*b* is a circuit logic diagram of the keynote memory control circuit block of FIG. 3*c;*
Figure 6C:
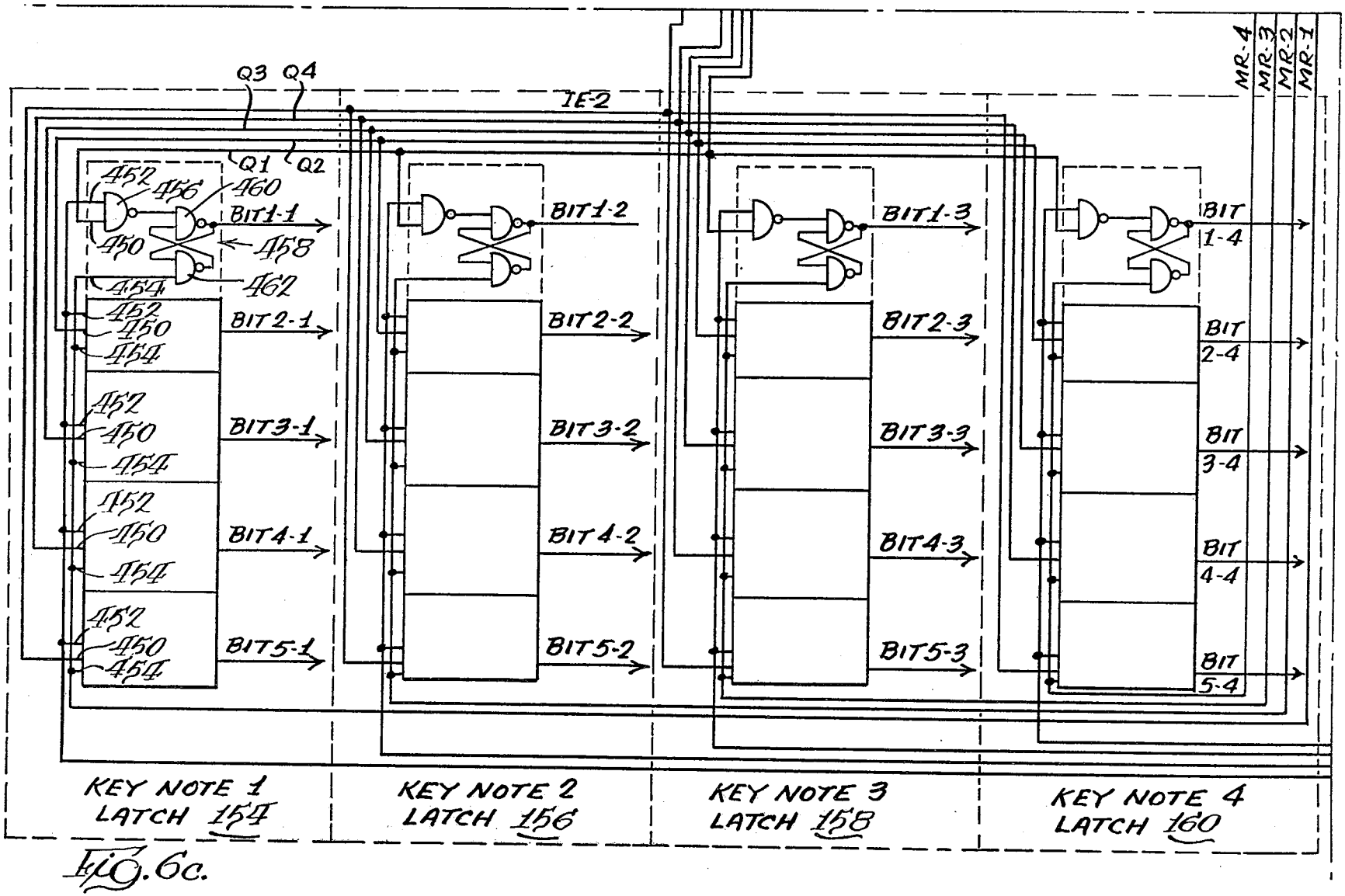
FIG. 6*c* is a circuit logic diagram of the keynote latch circuit blocks of FIG. 3*c;*

Referring now to FIG. 6*c*, each of the four keynote latch circuits 154–160 has five 1-bit latches with outputs respectively labeled Bit 1-N, Bit 2-N, Bit 3-N, Bit 4-N and Bit 5-N. Where N is the number associated with the keynote latch. Except for differences in external connections, all of the bit latches are identical and thus, for purposes of clarity, only the bit 1 latch of each keynote latch circuit is shown. Each 1-bit latch has a code input 450, a memory enable input 452, and a memory reset input 454. The information inputs 450 of the five latches of all four keynote latch circuits are respectively coupled to the code generator counter outputs Q-1, Q-2, Q-3, and Q-4 and the input multiplex generator output IE-2. All of the memory enable inputs 452 of each keynote latch circuit are connected together. The common memory enable inputs 452 of keynote latch circuits 154, 156, 158 and 160 are respectively coupled to memory enable outputs ME-1, ME-2, ME-3 and ME-4, respectively. Likewise, all of the memory reset inputs 454 of each keynote latch are connected together, and the common memory reset inputs 454 of keynote latch circuits 154, 156, 158, and 160 are respectively coupled to memory reset outputs MR-1, MR-2, MR-3 and MR-4, respectively.

Each one-bit latch comprises a NAND gate 456 having two inputs respectively coupled to the code input 450 and the memory enable input 452. The output of NAND gate 456 is connected to the set input of a NAND gate latch 458 defined by NAND gates 460 and 462. The latching input to NAND gate 462 is taken from the output of NAND gate 460, and the latching input to NAND gate 460 is taken from the output of NAND gate 462 in customary fashion. The reset input to NAND gate 462 is connected to the memory reset input 454.

When a 1-state memory enable pulse is applied to the memory enable input 452 in response to generation of a code select pulse from decoder 140, the NAND gate 456 is enabled to generate a 0-state set pulse to the set input of NAND gate 460. If the code generator counter input connected to the code input 450 is in a 1-state during the 1-state memory enable pulse, the output of NAND gate 456 switches to a 0-state. When NAND gate 456 switches to a 0-state, the latch output from NAND gate 460 switches to a 1-state. The latching input connections between NAND gates 460 and 458 maintain the output from NAND gate 460 in a 1-state so long as the signal applied to the reset input of NAND gate 462 from memory reset input 454 remains in a 1-state, regardless of subsequent changes in the signals applied to the second input of NAND gate 460. However, when a 0-state memory reset pulse is applied to memory reset input 454, the output of NAND gate 462 switches to a 1-state which causes NAND gate 460 to switch to a 0-state. If the code input 450 is in a 0-state when the memory enable pulse is operated, the NAND gate 460 remains in a 0-state and subsequent reset pulses have no effect.

VIII. Function Memory Logic Details

Figure 6D:
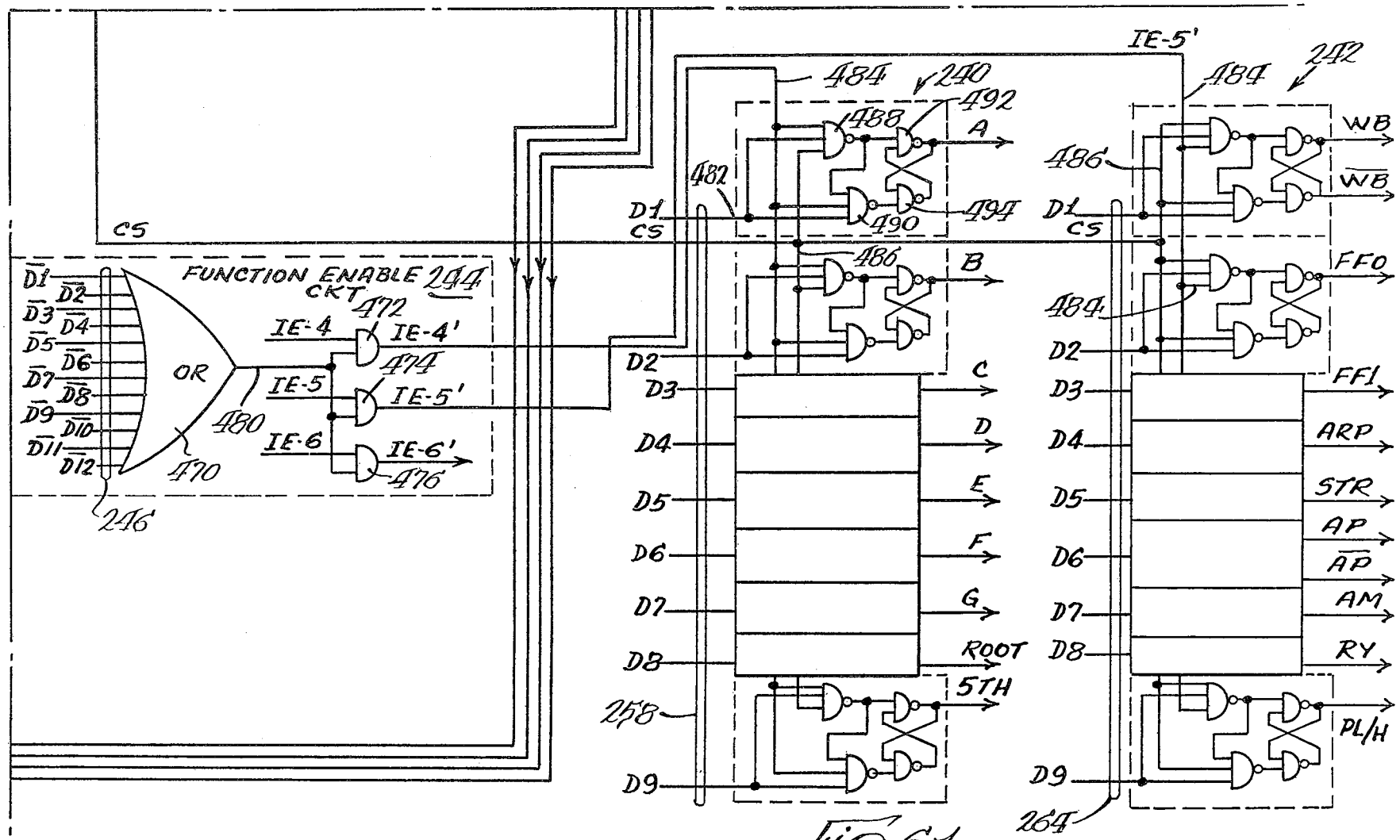
FIG. 6*d* is a circuit logic diagram of the function latch circuit and function enable circuit blocks of FIG. 3*b;*

The preferred embodiment auto function latch circuit 240, the manual function latch circuit 242 and the function enable circuit 244 of function memory 48, FIG. 3*b*, are shown in FIG. 6*d*. The function enable circuit 244 comprises an OR gate circuit 470, and three AND gates 472, 474 and 476. OR gate 470 has twelve inputs 246 respectively coupled to the outputs 152 of the twelve AND gates 272-294 of decoder 140. Thus, a 1-state signal is provided on the output 480 of OR gate 470 during the first twelve counts of code generator 138. Output 480 is connected to one input of each of AND gates 472, 474 and 476. AND gates 472, 474 and 476 also are connected with input multiplex generator outputs IE-4, IE-5 and IE-6, respectively. The output IE-6′ from AND gate 476 is utilized by the special effects circuitry. Output IE-4′ of AND gate 472 is coupled to the auto function latch circuit 240 and output IE-5′ of AND gate 474 is coupled to the manual function latch circuit 242. The signal appearing on output IE-4′ is a 1-state pulse beginning with the first count and terminating with the twelfth count of the code generator counter 138 during the fourth input enable period. The signal appearing on output IE-5′ is a similar pulse occurring during the fifth input enable.

The operation of the auto function latch circuit 240 is identical to that of the manual function latch circuit 242 except that the auto function latch circuit 240 is enabled during the period established by the signal on output IE-4′ whereas the latch circuit 242 is enabled during the period established by the pulse on output IE-5′. Each of the function latch circuits 240 and 242 comprises nine one-bit latches respectively providing function code signals on outputs A, B, C, D, E, F, G, ROOT and FIFTH and on outputs WB, $FF_0$, $FF_1$, ARP, STR, AP, AM RY and PL/H. Each latch has three inputs 482, 484, and 486. All inputs 486 are connected to the CS output of code selector 142. The inputs 484 of all of the latches of auto function latch circuit 240 are connected to function enable output IE-4′, while the inputs 484 of manual function latch 242 receive enable signals on function enable output IE-5′. Inputs 482 of the nine latches providing outputs A, B, C, D, E, F, G, ROOT and FIFTH are respectively coupled to the outputs 258 of the first nine AND gates 272-288 of decoder 140. The nine inputs 486 of function latch circuit 242 likewise respectively receive signals 264 from the outputs of these nine AND gates.

Each function latch comprises four NAND gates 488, 490, 492 and 494. NAND gates 492 and 494 are cross-connected to form a conventional latch with the latching input to NAND gate 494 being taken from the output of NAND gate 492 and the latching input to NAND gate 492 being taken from the output of NAND gate 494. The output of NAND gate 488 is connected to the set input of NAND gate 492, and the output of NAND gate 490 is connected to the reset input of NAND gate 494. Both NAND gates 488 and 490 receive the function enable signal IE-4′ or IE-5′ provided at input 484. Both NAND gates 488 and 490 also receive decode pulses from decoder outputs D1 through D9. NAND gate 488 also receives code select pulses at input 486, and the output of NAND gate 488 is connected to a third input to NAND gate 490.

A 1-state signal is entered into the function latches whenever a 1-state signal is provided at the associated encoding logic input during the appropriate input enable period. For example, in order to enter a 1-state function select signal in function latch A, a 1-state signal is applied to the A input 106 of auto function selection input circuit 34 (FIG. 5). This, as discussed above, will result in a code select pulse being generated during a count of one of code generator 138 during the fourth input enable period. This is applied to inputs 486 of set NAND gates 488. A 1-state pulse from output D1 of decoder AND gate 272 is provided to inputs of both set and reset NAND gates 488 and 490 simultaneously with the code select pulse. In addition a 1-state function enable signal IE-4′ is provided on input 484. Thus, the latch developing function output A at the occurrence of the code select pulse corresponding to function A has all three of its inputs at gate 488 in a 1-state when the code select pulse is generated. When this occurs, the set NAND gate 488 switches to a 0-state, which causes NAND gate 492 to switch to a 1-state. The NAND gate 492 remains latched in the 1-state by the 0-state output from NAND gate 488. The other latches do not respond to the code select pulse corresponding to function A for the input 482 as these other gates do not receive a 1-state decode pulse simultaneously therewith. NAND gate 488 continues to generate a 0-state pulse in response to the code select pulse of its function until the A input 106 of the auto function selection circuit 34 is returned to a 0-state. When the input A is switched to a 0-state, a code select pulse is not generated during the first count of code generator 138 when the 1-state pulse is generated on decoder output D1. Accordingly, a 0-state pulse is not generated on the output of NAND gate 488 at this time, and 1-state signals are provided to all three inputs of reset NAND gate 490. NAND gate 490, in response thereto, generates a 0-state pulse on its output that resets the latch, returning output A to a 0-state. Thus, so long as an input function selection signal is applied to one of the function selection inputs by means of either manual actuation of a function selection switch, as in function selection switch circuit 36 or by other means automatically generating such a signal such as auto code generator 108 the output of the function latch associated therewith will remain in a 1-state throughout all cycles of operation.

IX. Tone Selection Logic Details

Returning to the description of the note selection circuitry, FIG. *7a* is an illustration of a preferred embodiment of the keynote code select circuit 176, the pedal note select circuit 180 and the tone selector circuit 52. The keynote code select circuit 176 comprises four substantially identical gating circuits 492, 494, 496 and 498 which respectively receive the bit 1 through bit 4 outputs from keynote latch circuits 154, 156, 158 and 160, and successively gate them through to outputs BIT 1-S through BIT 4-S. Each of these gating circuits comprises four NAND gates 500, 502, 504 and 506. The pedal note code select circuit 180 is identical to the keynote gating circuits and gates the input code signals at P1 through P4 through to outputs BIT 1-S through BIT 4-S in succession with the keynote codes. The outputs of all NAND gates 500 are commonly connected to a single output line BIT 1-S. All NAND gates 502, 504 and 506 are likewise commonly connected to single output lines BIT 2-S, BIT 3-S and BIT 4-S. All four NAND gates of the gating circuits 492–498 and pedal note code select circuit 180 are respectively connected to outputs 501, CE-1, CE-2, CE-3, CE-4 and CE-P of note code multiplex enable generator 64, FIG. *7c.*

Each gating circuit gate 500-506 passes the note code at its inputs to the tone selector 52 when a 1-state note code enable signal is applied to the inputs of all the NAND gates thereof. The note code multiplex enable generator 64 generates 1-state pulses on its outputs CE-1 through CE-4 and CE-P in ring counter-like fashion at a frequency greater than that at which the memory enable pulses on outputs ME-1 through ME-4 (FIG. 3c) are generated. When a 1-state note code enable pulse is generated on output CE-1, all of the NAND gates of gating circuit 492 are enabled, and the note code on outputs BIT 1-1 through BIT 4-4 of the keynote latch circuit 154 are respectively transferred on outputs BIT 1-S through BIT 4-S to tone selector circuit 52. At the end of the 1-state code enable pulse on output CE-1, the NAND gates of gating circuit 492 are disabled, and the NAND gates of gating circuit 494 are enabled to transfer the note code information of keynote latch 156. Gating circuits 496 and 498 and the pedal note code selector circuit 180 are successively enabled and disabled, in turn, in the same fashion. The note code multiplex enable generator 64 is free-running, and the transfer of note code information from the note code memory to the tone selector circuit 52 is thus continuous.

Figure 7A:
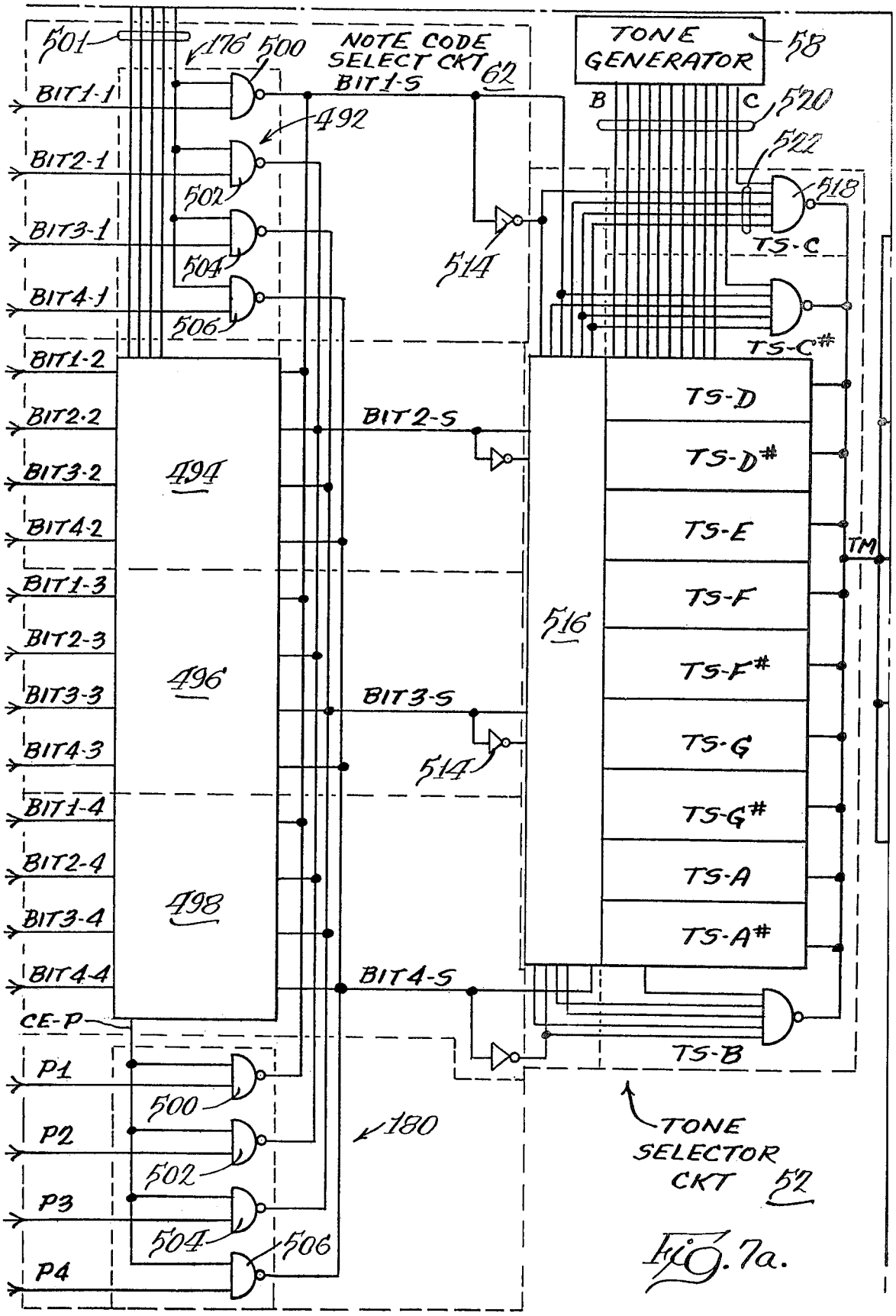
FIG. 7*a* is a circuit logic diagram of the note code select circuit tone generator and tone selector circuit blocks of FIG. 3*c;*
Figure 7B:
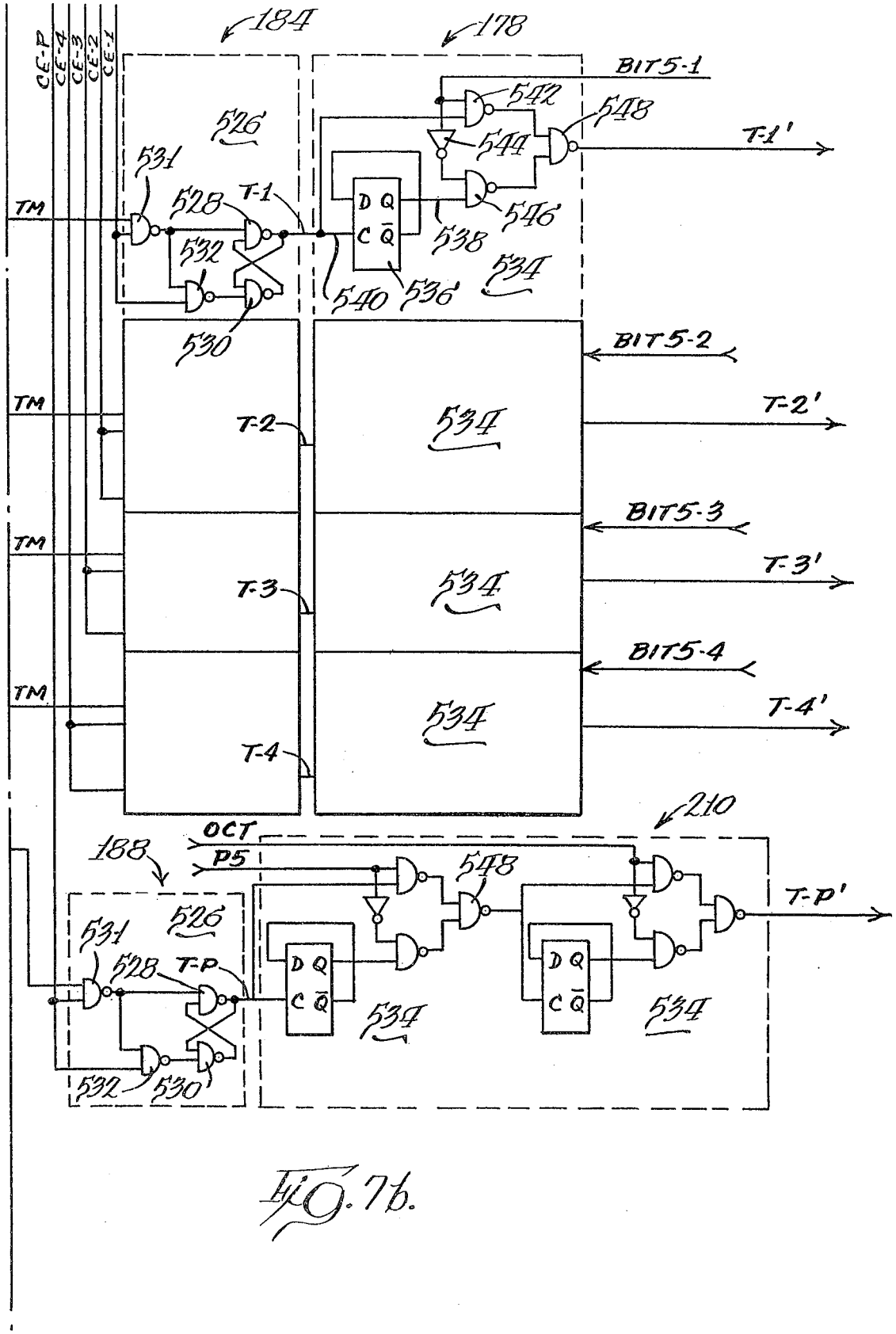
FIG. 7*b* is a circuit logic diagram, partially in block form, of the tone latch circuit and the octave select circuit blocks of FIG. 3*d;*
Figure 7C:
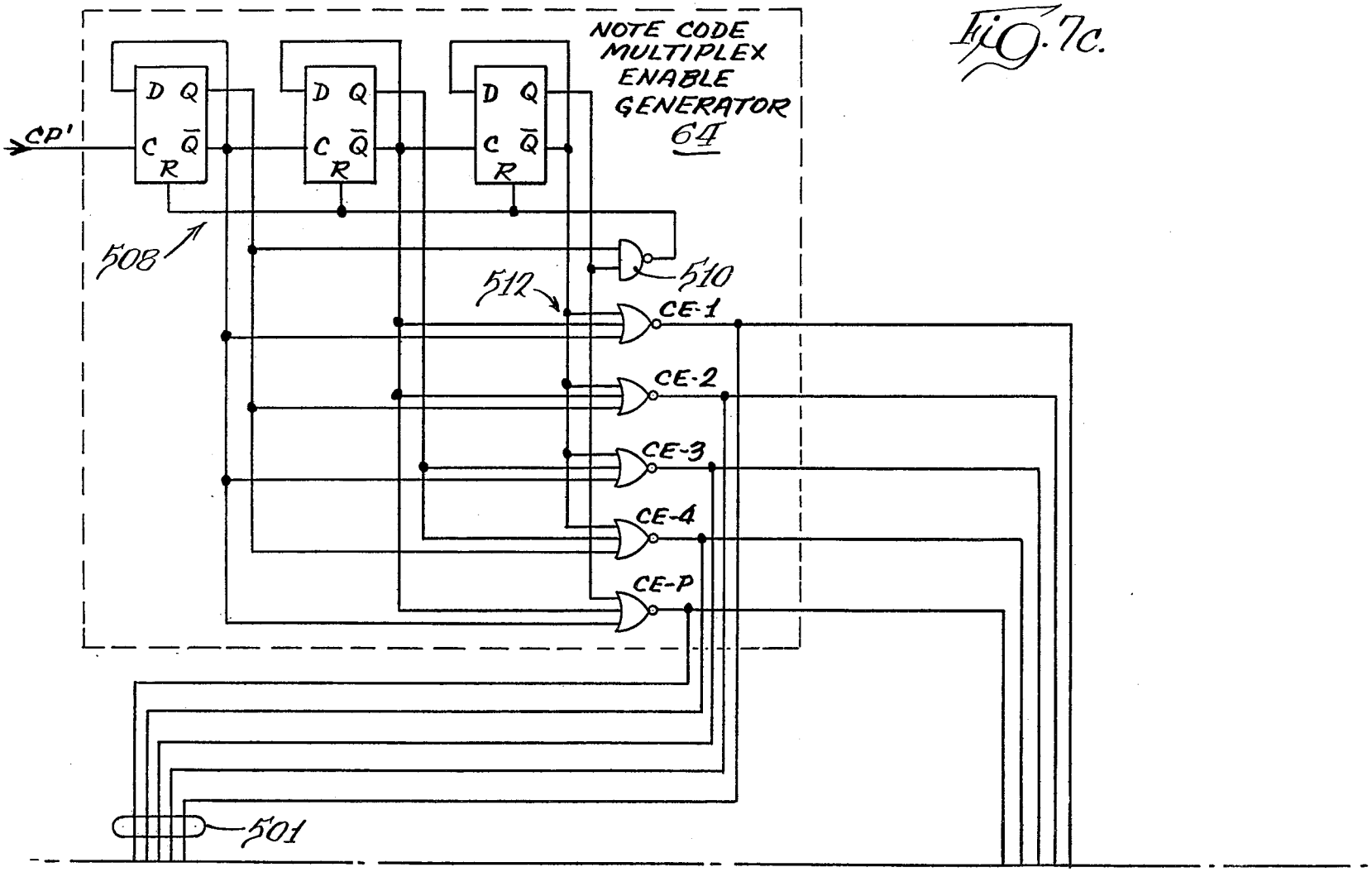
FIG. 7*c* is a circuit logic diagram of the note code multiplex enable generator block of FIG. 3*c;*

Referring to FIG. 7c, the note code multiplex enable generator 64 is seen to comprise a three-stage binary counter 508 driven by high frequency signals from clock 40 on its output CP′, a NAND gate 510 for resetting the three flip-flops of counter 508 at the end of a binary count of five, and five NOR gates 512 for producing the code enable 1-state pulses on their respective outputs CE-1 through CE-4 and CE-P. The five NOR gates 512 are appropriately connected with Q and Q outputs of counter 508 to respectively decode binary counts of one through five thereof. For example, when the binary count of counter 508 is three, a 1-state pulse is provided on output CE-3, and 0-state signals are provided on all of the remaining outputs.

The stored-note codes provided on outputs BIT 1-S through BIT 4-S, and the inverse of each, respectively provided by four inverters 514, are connected to a note code output bus 516 of tone selector 52. Tone selector 52 comprises twelve tone select circuits respectively labeled TS-C, TS-C sharp, TS-D, TS-D sharp, TS-E, TS-F, TS-F sharp, TS-G, TS-G sharp, TS-A, TS-A sharp and TS-B. Each of these twelve tone select circuits comprises a NAND gate 518, only two of which are shown. The twelve NAND gates 518 have inputs respectively coupled to twelve outputs 520 of tone generator 58 on which twelve different rectangular wave tone signals are produced. The twelve tone signals have different frequencies which are substantially related to one another as the twelve notes of a musical scale, as indicated by the label suffixes of the tone select circuits connected therewith.

Each of NAND gates 518 also has inputs connected with an appropriate four of the BIT 1-S through BIT 4-S and the four inverter 514 outputs associated therewith to decode one of the twelve note codes. For example, the NAND gate 518 of tone select circuit TS-C has one input connected with the output 520 on which the tone signal corresponding to the musical note C is produced, and four inputs respectively coupled with outputs BIT 2-S, BIT 3-S, BIT 4-S and the inverse of BIT 1-S. If a binary one is stored in any of the keynote latch circuits or the pedal note latch circuit, when the code enable pulse for that latch is generated, logic 1-state signals will appear on all four note code inputs 522 of NAND gate 518 of select circuit TS-C. If the tone signal is in a binary 1-state at that same time, the output of NAND gate 518 will switch to a logic 0-state. During the period of time that the tone signal is in a 0-state, the NAND gate output will remain in a 1-state regardless of selection of a note code therefor. At all other times, the output of NAND gate 518 will remain in a 1-state. The remaining tone select circuits operate in an identical fashion, each switching to a 0-state when the tone signal connected therewith is in a 1-state and the binary code for the note corresponding thereto appears on outputs BIT 1-S through BIT 4-S.

Since the binary code for only one note can appear on the outputs of note code select circuit 62 at any given time, only one of NAND gates 518 switches to a 0-state at any one time. This permits connecting the outputs of all NAND gates 518 together to form a single output TM. The signal that appears on output TM is of course the time division multiplexed composite of the four tone signals corresponding to the stored codes.

Referring to FIG. 7*b*, the time division multiplexed key and pedal tone signals on output TM are demultiplexed respectively by key tone latch circuit 184 and pedal tone latch circuit 188 under control of the note code multiplex enable circuit 64. The key tone latch circuit 184 comprises four latches 526 which respectively demultiplex the four different tone signals selected in accordance with the codes stored in the four keynote latches. The keynote selected tone signals are respectively provided on outputs T-1, T-2, T-3 and T-4. Pedal tone latch 188 also comprises a latch 526 identical to that of the key tone latches. It produces a demultiplexed tone signal on its output T-P corresponding to the note code stored in pedal note latch 162.

Each of latches 526 comprises a pair of NAND gates 528 and 530 connected together in a conventional latch configuration. The set input to NAND gate 528 is taken from the output of a set input NAND gate 531, and the reset input to NAND gate 530 is taken from a reset NAND gate 532. The multiplexed tone signal on output TS is coupled to one input of all set NAND gates 531. Each of NAND gates 531 has an input connected with an associated output CE-1 through CE-4 and CE-P of note code multiplex enable generator 64. Each of reset NAND gates 532 also has one input connected with an associated output of note code multiplex enable generator 64 and the other input connected with the output of its associated NAND gate 531.

Tone latches 526 function in a manner similar to that of the function latches. If the multiplexed tone signal on output TM is in a 1-state during the occurrence of a 1-state note code enable pulse associated therewith, the output of NAND gate 531 will switch to a 0-state and the output of NAND gate 528 will latch into a 1-state. The 0-state output on NAND gate 531 prevents NAND gate 532 from also generating a 0-state reset pulse during this time. At the end of the code enable pulse, NAND gate 531 reverts back to a 1-state, but NAND gate 528 remains in a 1-state due to the latching configuration with NAND gate 530. The output of NAND gates 528 will remain in a 1-state until termination of the 1-state pulse of the tone signal. As soon as a note code enable pulse occurs when the multiplexed tone signal is in a 0-state, the output of NAND gate 531 does not switch to a 0-state, but remains in a 1-state. This condition enables reset NAND gate 532 to respond to the note code enable pulse and switch to a 0-state. When NAND gate 532 switches to a 0-state, the NAND gate 528 switches back to a 0-state. The output of NAND gate 528 remains in a 0-state until the tone signal again switches to a 1-state. Thus, it is seen that five separate tone signals may be simultaneously generated on outputs T-1, T-2, T-3, T-4, and T-P, with the use of only a single tone selector circuit 52 for all tones. This is made possible by the use of the multiplexing technique and results in great circuit economy.

The frequencies of the tone signals correspond to that of the octave associated with the second manual keyboard switches 100. As previously discussed, the fifth bit of the note code designates the octave in which the tone corresponding thereto is to be played. Still referring to FIG. 7*b*, the key tone octave selection circuit 178 and the pedal tone octave selection circuit 210 are seen to be controlled by the fifth bit stored in the keynote latches 154–160 and the outputs P5 and OCT from the special effects circuitry 38. A selectable divider circuit 534 is provided for each of the key tone latches 526, and two selectable divider circuits 534, respectively controlled by outputs P5 and OCT from special effects circuitry 38, are provided for the pedal tone latch circuit 188.

Each circuit 534 comprises a flip-flop 536 producing a tone signal on its output 538 having one-half the frequency of the tone signal applied to its input 540, and a selection circuit for selectively applying either the reduced frequency tone signal or the nonreduced frequency tone signal. This selection circuit comprises a NAND gate 542 having one input connected with the output of its associated tone latch 526 and an octave select control input connected with the octave information bit. The octave select control input is provided by the BIT 5 output from a keynote latch or the P5 or OCT output from the special effects circuitry input. The octave select control input signal is also applied through an inverter 544 to a NAND gate 546, which receives the reduced frequency tone signal at another input thereof from flip-flop 536. The outputs of both NAND gates 542 and 546 are applied to a NAND gate 548 having an output on which the octave selected tone signal is developed.

When the octave select control input signal is in a 1-state, NAND gate 546 is disabled from responding to the output of flip-flop 536 and the frequency developed on the output of NAND gate 548 is the same as that developed by the tone latch 526 associated therewith. However, with the octave select input signal in a 0-state, NAND gate 542 is disabled, and NAND gate 546 is enabled to respond to the reduced frequency signal from flip-flop 536. Accordingly, the frequency of the tone signal produced on the output of NAND gate 548 is reduced by one-half, which is approximately the reduction necessary for a one octave reduction in the tone signal.

In the pedal tone octave select circuit 210, the outputs from NAND gate 548 of the selectable divider circuit 534 controlled by output P5 is applied to the input of the second selectable divider circuit 534 controlled by output OCT. Thus, the frequency of the signal produced on output TP' thereof may be selectively reduced by one octave by applying a 1-state signal to either one of the P5 and OCT control inputs or may be reduced by two octaves by applying a 1-state signal to both control inputs.

When the pedal note latch circuit 162 receives its input from the pedal clavier, both the P5 and the OCT inputs are in a 1-state. Likewise, whenever the note code stored in one of the keynote latches is one selected from the first octave manual keyboard, the stored fifth bit taken from IE-2 is in a 0-state and the frequency is reduced accordingly.

X. Note Memory Control Circuit Logic Details

A first circuit embodiment of the keynote memory control 164 is shown in FIG. 6*b* and will be described with reference to some of the waveforms shown in FIG. 8*a*. The keynote memory control includes a memory control counter 360, a memory reset generator 362, a memory enable generator 364, a memory counter decoder 361, a detection circuit 365, and a gating logic circuit 366.

The memory control circuit 164 has two modes of operation: a memory mode which is the mode of operation when function latch output AM is in a 1-state and a nonmemory mode when the function latch output AM is in a 0-state. Function latch output AM is connected to an input of an AND gate 367 and to an input of a NAND gate 369, both of which are associated with detection circuit 365. Function latch output AM is also connected to an input of a NOR gate 371 of memory reset generator 362. When operating in the memory mode, the generation of reset and enable pulses is controlled in part by detection circuit 365 and NOR gate 371 is disabled from responding to signals on a 0 NOTES output of counter decoder 361. In the nonmemory mode, with AM output in a 0-state, NAND gates 357 and 369 are disabled from providing control signals, and NOR gate 371 of memory reset generator 362 is enabled to respond to the 0 NOTES output of memory counter decoder 361.

The operation of memory control circuit 164 in the nonmemory mode will first be described. The note latches are reset or cleared in response to two different conditions. First, the latches are reset in response to memory enable pulses. The memory enable generator 364 functions to generate a 1-state enable pulse on one of its outputs ME-1 through ME-4 in response to the first four code select pulses generated during the first and second input enable periods. The memory reset generator 362 generates a 0-state reset pulse on one of its outputs MR-1 through MR-4 at the beginning of, and in response to, generation of a memory enable pulse on an associated one of memory enable generator outputs ME-1 through ME-4. For example, the second code select pulse generated during the first and second input enable periods will result in generation of a 1-state memory enable pulse on output ME-2 which, in turn, at the beginning thereof, will result in the generation of a 0-state reset pulse on output MR-2. Likewise, pulses will be generated on output Mr-1, MR-3 and MR-4, repectively, and outputs ME-1, ME-3 and ME-4, respectively, in response to the first, third and fourth code select pulses generated during the first and second input enable periods. The reset pulses at the beginning of each enable pulse clears the note latch associated therewith prior to entry of the new code. It should be noted tha the duration of the rest pulse is very short and that the effect of the reset time of the note latches has no detectible effect on the audible output sould of the organ. The reset time in the embodiment shown is in the range of 0.1 $\mu$sec.

The second condition permitting the resetting of a latch is nonentry of a new code. At the end of the second input enable period, the memory reset generator 362 generates reset pulses on all of its outputs associated with note latches that did not receive an enable pulse. The selection is made in accordance with the counts of memory control counter 360 as indicated by the 0 NOTES, 1 NOTE, 2 NOTES and 3 NOTES outputs of counter decoder 361.

The memory control counter 360 is seen to comprise three flip-flops 368, 370 and 372 connected in customary binary counter fashion. The counter 360 counts pulses developed on the output of a NOR gate 373 connected to the clock input of the first stage flip-flop 368. The normal or Q outputs and inverted or Q outputs of each of the three flip-flops are appropriately connected to five NOR gates 388 of counter decoder 361 so that they respectively decode counts of zero, one, two, three and four. On a count of four, a 1-state pulse pulse is generated on the 4 NOTES output of the fifth NOR gate 388 which is coupled to one of the inputs of NOR gate 373. NOR gate 373 is thereby prevented from providing any further pulses to memory control counter 360, and thus, the maximum count tht memory control counter 360 can reach is a count of four.

Until a count of four is reached, however, 1-state pulses are generated on the output of NOR gate 373 in response to 0-state valid input enable pulses on output VI of a NAND gate 375. nANd gate 375 has one input connected to an OR gate 378 which performs an OR function on the input enable signals on output IE-1 and IE-2 and another input connected to the code select output CS. Thus, each time a code select pulse is generated during either the first or second input enable period, a 0-state valid input enable pulse is generated on the output of NAND gate 375, and memory control counter 360 is advanced by one count.

The pulse produced on the output of NOR gate 373 is delayed by one-half period of the clock signal on output CP, which is also coupled to an input of NOR gate 373. This is illustrated in waveforms (1), (2) and (3) of FIG. 8*a*. The inverse of a representative valid input enable pulse VI is shown in waveform (2). As can be seen, when the clock pulse and the valid input enable pulse are both in a O-state, a 1-state pulse is developed on the output of NOR gate 373.

The memory enable generator 364 comprises four AND gates 379 and four AND gates 377. AND gates 379 respectively produce 1-state enable pulses on outputs ME-1 through ME-4 in response to 1-state pulses developed on outputs ME-1′ through Me-4′ of AND gates 377. AND gates 377 respectively receive input signals from the 0 NOTES, 1 NOTE, 2 NOTES and 3NOTES outputs of decoder 361. Only one of these decoder outputs has a 1-state thereon at any one time and thus only one of the four AND gates 377 is enabled to generate a 1-state pulse. Each of the AND gates 377 has an input connected with the CP output of clock 40 and each has an input connected with the output of an AND gate 381. AND gate 381 has one input connected to the output of an inverter 383 on which is produced the inverted valid input enable pulse signal $\overline{VI}$, illustrated in waveform (2). Another input of AND gate 381 is taken from the CP′ output of a delay gate 384 on which a clock signal delayed relative to the clock signal developed on output CP is developed, as illustrated in waveform (4). Thus, each time the inverted valid input enable signal, the delayed clock signal on output CP′ and the clock signal developed on output CP are all in a 1-state, a 1-state memory enable pulse is produced on the output of the one AND gate 377 which is enabled, as illustrated in waveform (5) of FIG. 8*a*.

The memory control counter 360 is reset to a count of zero at the end of the second input enable period in response to a 0-state pulse developed on the output of an inverter 385. The input to inverter 385 is connected with the multiplex enable output IE-3 and thus generates this 0-state on its output at the beginning of the third input enable period. Thus, at the beginning of each first input enable period, the count in memory control counter 360 is zero, a 1-state signal is present on the 0 NOTES output of counter decoder 361 and the one AND gate 377 providing memory enable pulses on output ME-1′ is enabled to respond to the first valid input pulse. Accordingly, in response to the first valid input enable pulse VI, a 1-state memory enable pulse will be generated on output ME-1′, and thus, ME-1 and the code being generated coincidentally therewith will be entered into the first keynote latch circuit.

As can be seen by comparing waveforms (3) and (5), at the end of the memory enable pulse, a 1-state pulse is generated on the output of NOR gate 373. The counter, in response thereto, advances to a count of one and accordingly, a 1-state signal appears on a 1 NOTE output of counter decoder 361. The second memory enable AND gate 377 is then enabled to respond to the second valid input enable pulse. The third and fourth AND gates 377 are enabled in like fashion and generate memory enable pulses on outputs ME-3′ and ME-4′, respectively in response to the third and fourth valid input pulses. Since only four keynote latches are provided, fifth and subsequent valid input enable pulses are of course ignored. It should be understood, however, that if more keynote latches were provided, an equal number of memory enable gates would be added and the counter would be permitted to count up to that number.

The outputs ME-1, ME-2, ME-3 and ME-4 of AND gate 379 are respectively coupled to inputs of four NAND gates 385 of memory reset generator 362. Each of the four NAND gates 385 also has an input taken from an output CP″ of an inverting delay gate 390. A clock signal is produced on output CP″ which is inverted and delayed with respect to the clock signal on output CP of clock 40, as illustrated in waveform (6) of FIG. 8*a*. 0-state reset pulses are respectively produced on outputs MR-1′ through MR-4′ of NAND gates 385 in response to 1-state memory enable pulses developed on outputs ME-1 through ME-4. As seen in waveform (7), the 0-state pulse is developed during the period of time that both the delayed clock signal on output CP″ and the memory enable pulse are in a 1-state. This occurs at the beginning of the 1-state memory enable pulse which causes the reset pulse.

The 0-state reset pulse dominates control of the note latch, and the note latch is thereby cleared in the beginning of each memory enable pulse therefor. At the termination of the 0-state reset pulse, the continuation of the 1-state memory enable pulse enables entry of the note code identified thereby. The MR-1′ through MR-4′ of the four NAND gates 385 are respectively connected to inputs of four AND gates 387 which respectively produce the 0-state reset pulses in response thereto on outputs MR-1 through MR-4.

Reset pulses are also selectively generated on the outputs of reset AND gates 387 in response to the thirteenth clock pulse occurring during the second input enable period. The selection of which of the AND gates 387 will generate the 0-state reset lulse is based upon the count of memory control counter 360. Specifically, the selection is such that reset pulses are generated on al of the memory reset AND gates 387 associated with latches that were not reset in response to memory enable pulses occurring during the immediately preceding first and second input enable periods. The thirteenth clock pulse generated during the second input enable period is decoded by a NOR gate 389 having one input connected through an inverter 391 to input multiplex enable generator output IE-2 and another input connected to the $\overline{D13}$ output of encoding logic circuit 30. NOR gate 389 generates a 1-state $\overline{D13}$ reset pulse in response to the 0-state pulse generated on output D13 during the second input enable period. This D13 reset pulse is illustrated both in waveform (*k*) of FIG. 4 and waveform (8) of FIG. 8*a*.

The D13 reset pulse is applied through an AND gate 393 to each of four memory reset NAND gates 395, 397, 399 and 401, the outputs of which are respectively connected to inputs of the four reset AND gates 387. Each of the memory reset NAND gates 395 – 401 has a second input. Each one of the NAND gates that has its second input in a 1-state when the D13 reset pulse is generated a 0-state reset pulse on its output.

Reset NAND gate 395 has its second input taken from the output of NOR gate 371 which provides a 1-state pulse thereto whenever the 0 NOTES counter decoder output is in a 1-state. The second inputs of NAND gate 397, 399 and 401 are respectively taken from the outputs of three OR gates 403, 405 and 407. OR gate 403 has two inputs respectively connected to the 1 NOTE output of the counter decoder 361 and the output of NOR gate 371 and thus provides a 1-state signal on its output whenever the memory control counter 360 has a count of zero or one. OR gate 405 has three inputs respectively taken from the output of NOR gate 371, and the 2NOTES and 3 NOTES outputs of counter decoder 361. Accordingly, OR gate 405 provides a 1-state signal on its output whenever memory control counter 360 has a count of zero, one or two. OR gate 407 is connected with the 1 NOTE, 2 NOTES and 3 NOTES output of decoder 361 and the output of NOR gate 371 to decode counts of zero, one, two or three.

Thus, depending upon the count of memory control counter 360 at the time the D13 reset pulse is generated, 0-state reset pulses will be selectively applied to the four keynote latches. With a count of zero, indicating that no keys are being held down, 0-state reset pulses will be generated on all four reset AND gates 387. Likewise, with a count of one, 0-state reset pulses will be generated on outputs MR-2 through MR-4, but not on output MR-1. With a count of two, reset pulses are generated on outputs MR-3 and MR-4. With a count of three, a reset pulse is only generated on output MR-4, and with a count of four, indicating that four note keys are being held down, none of the keynote latches are reset in response to the D13 reset pulse.

Thus, it can be seen that all of the keynote latches are reset during each first and second input enable period. If a note key is held down, a reset pulse will be generated in response to a memory enable pulse and the keynote latch will be loaded with the note code corresponding thereto. If a key-notch latch has not received an enable pulse by the end of the second enable period, a reset pulse is applied thereto in response to the D13 reset pulse, and the latch is cleared.

During operation in the memory mode, the keynote latches are not al reset during each first and second inputenable period. The note codes, oncestored, remain in storage until detection of a change in the number of note selections by the operator indicating selection of a new set of notes. Specifically, the detection circuit 364 inhibits resetting of the keynote latches until an increase in the number of keys being held down from zero keys to at least one note key is detected. This permits the selected notes for which note codes have been stored to be played after the organist has released the keys corresponding thereto. For example, the organist may select the accompaniment memory function and a repetitive arpeggio function, press down four keys, and have an arpeggio function performed repetitively with the four selected notes after he has released the keys. This is a very important advantage for the organist as it frees his left hand to perform additional functions, for instance, to play a melody on a different keyboard.

The accompaniment memory mode of operation is achieved through control by detection circuit 365. When the accompaniment memory latch output AM is in a 1-state, NAND gate 369 provides a 0-state signal on its output IR except upon detection of the change in note selection discussed above. This 0-state signal applied to the input of NAND gate 393 disables it from providing a 1-state signal to the memory reset NAND gates 395-401 in response to the D13 reset enable pulse. The 1-state signal on output Am also disables NOR gate 371 from applying a 1-state signal on its output to NAND gate 395 and OR gates 403 to 407 so that even when NAND gate 393 is enabled, reset pulses will not be generated in response to the D13 reset enable pulse.

The 1-state signal on function latch output AM applied to the input of NAND gate 367 enables it to respond to a 1-state signal applied to its other input from a monostable multivibrator or one-shot 409. When in its stable state, oneshot 409 provides a 1-state signal on its output Q to NAND gate 367. This results in a 0-state signal being applied to each of the four memory enable AND gates 379. This 0-state signal disables all of the memory enable AND gates 379 from generating 1-state memory enable pulses on their respective outputs. Consequently, reset NAND gates 385 connected therewith are disabled from generating 0-state reset pulses.

The selected change in note selection detected by circuit 365 is achieved by means of a latch 411, a NAND gate 413 and a NAND gate 415. NAND gate 413 has one input connected with the 0 NOTES output of counter decoder 361 and another input connected to the D13 output of NOR gate 389. The output of NAND gate 413 is connected to the set input of latch 411. Accordingly, whenever the count of memory control counter 360 has a count of zero at the end of the second input enable period, a 0-state set pulse is generated on the output of NAND gate 413 in response to the D13 reset enable pulse. Latch 411 switches to its set state with a 1-state signal on its output 417 in response thereto. The output of NAND gate 413 is also applied to the reset input of a latch 419 which, in response to the 0-state pulse, switches to its reset state with a 1-state signal on its output 421. Output 421 is applied to the reset input 423 of latch 411. Accordingly, latch 411 remains in its set condition until latch 419 is set.

The 1-state signal on output 417 is applied to the input of NAND gate 415 and enables it to respond to a 1-state pulse at its other input connected with the 1 NOTE output ofcounter decoder 361. Accordingly, as soon as one or more note keys are held down after a condition when all have been released, a 0-state pulse is generated on an output U of NAND gate 415. This 0-state update pulse is applied through a line 425 to the input of the three reset AND gates 387, respectively producing 0-state reset signal on outputs MR-2 through MR-4. Accordingly, the keynote latch circuits 156, 158 and 160, FIG. 6*c*, are reset in response to generation of the first valid input pulse.

The 0-state update pulse is also applied to the set input of latch 419 and to the set input of one-shot 409. Latch 419 in response thereto switches to its set condition with a 0-state on its output 421 and a 1-state on its output 427. The 1-state on output 427 results in the NAND gate 369 switching its output IR to a 0-state. The 0-state signal on output IR is applied to AND gate 393 which is thereby inhibited from passing a reset enable pulse. The 0-state pulse developed on output 421 of latch 419 also reset latch 411 and thereby terminates the 0-state update pulse.

One-shot 409, in response to the update pulse, switches to its unstable state with a 0-state signal on its Q output. This causes the output of NAND gate 367 to switch to a 1-state for the duration of the one-shot period. During the one-shot period, the memory enable AND gates 379 are enabled to generate 1-state memory enable pulses. A 100 millisecond period for one-shot 409 has been found to be a suitable period for enabling memory enable AND gates 369. The organist must press down keys for all of the notes which he desires to be entered into storage within 100 milliseconds of pressing down the first key. Thus, if three note keys are pressed down, the pressing down of a fourth note key after 100 milliseconds have passed will not result in storage of the code correspondimg thereto. It has been found that this requirement is easily fulfilled by most organists. In order to enter the code for the fourth key in the memory mode of operation, all keys must first be released and then all four pressed down within the 100 millisecond period.

The memory enable AND gates 379 are normally disabled to prevent undesirable resetting of the latches by NAND gates 385. The decoder 140 inputs are scanned from the inputs associated with the lowest note of an octave to the input associated with the highest note of an octave. Accordingly, in the memory mode if the memory enable AND gates 379 were not normally disabled, successive releasing of a plurality of keys from the lowest note to the highest note last would result in entry of the code of the highest note into all of the note latches that had stored the initial selection of note codes. For example, if four note keys were held down, the code corresponding to the highest note would be entered into the fourth kegnote latch 160. If the lowest note were then released, the code corresponding to the highest note would be entered into the third latch 158 and the code corresponding to the second highest note of the original selection of four notes would be entered into the first keynote latch 154.

If the keys are released in descending order, on the other hand, this problem is not encountered. Thus, if it were desired to train the organist to release the keys in descending order, the solution provided by the circuitry including one-shot 409 could be eliminated. That is, the 100 millisecond limitation for the selection of all notes for storage could be eliminated. However, it has been found to be easier to train the organist to select all notes to be selected within 100 milliseconds than to release the keys in descending order. Accordingly, the provision of circuitry inhibiting the memory enable AND gates 379 during memory mode operation is preferred.

XI. Logic Details of an Alternate Embodiment of the Note Memory Control Circuit Referring to FIGS. 8, 8*a*, and 8*b*, another circuit embodiment 164' of keyboard memory control 164 is shown which may be used in place of, and is more versatile than, the keynote memory control 164 shown in FIG. 6b. Elements of memory control 164' which correspond to those of the memory control 164 are given the same reference designations. The memory control 164' has all of the inputs of memory control 164 and additionally receives the clock signals on output CP of clock 40. The memory enable pulses and memory reset pulses are respectively generated on outputs ME-1 through ME-4 and MR-1 through MR-4, which are connected with the keynote latches in the same fashion as the corresponding outputs in the meory control 164 shown in FIG. 6*b*.

Like memory control 164, memory control 164' has two modes of operation depending upon the state of the accompaniment memory latch output AM. With the accompaniment memory function not selected, i.e., with output AM in a logic 0-state, the memory control 164' functions in a manner very similar to that of memory control 164. In this mode of operation, the keynote latches are reset in accordance with the count of memory control counter 360, as indicated by the outputs of decoder 361, in response to the $\overline{D13}$ reset pulse, i.e., the pulse appearing on outputs $\overline{D13}$ during the second input enable period. During this mode of operation, if the key switches are not held in a closed position by the operator, the latches storing the note codes corresponding thereto are reset and production of the corresponding output tone signals terminates. In the memory mode, i.e., in the mode of operation when the function latch output AM is in a logic 1-state, a note code stored in one of the keynote latches will remain in the latch even though the operator releases the key switch corresponding thereto. Unlike the memory control 164 of FIG. 6*b*, in which all keys must be released before the note latches can be reset, the memory control 164' permits continuous updating of the note code latches without the necessity of releasing all keys of the initially held down. All of the latches are reset when an increase in the number of closed key switches is detected. For example, updating of all latches will occur when an organist, holding four keys down, releases one key down while continuing to hold three down, and then selects the same or a different fourth key down.

A more detailed description of the operation of memory control 164' when operating in the nonmemory mode is described with reference to the waveforms shown in FIG. 8a. The memory control counter 360 receives its input from the output of a NOR gate 550 which in turn has three inputs. One of the inputs is connected to the CP output of clock 40, one of the inputs receives valid input pulses from AND gate 376, and the remaining input is taken from the 4 NOTES output of decoder 31. A 0-state valid input pulse is generated in response to each code select pulse applied to the input of NAND gate 376 during the either the first or second input enable period. Exemplary clock pulses ad the inverse of a valid input enable pulse, designated VI, are respectively shown in waveforms (1) and (2) of FIG. 8*a*. Memory control counter 360 advances by one count in response to each valid input pulse up to a maximum count of four. As with the control of FIG. 6*b*, when the counter reaches a count of four, a 1-state pulse developed on the 4 NOTES output of decoder 361 and applied to the input of NOR gate 550 prevents NOR gate 550 from responding to further valid input pulses. A typical memory counter input signal provided by NOR gate 550 is shown in waveform (3) of FIG. 8a. The transitions of the memory control counter 360 and thus the transitions of decoder 361 occur at the positive going transitions of the memory counter input signal from NOR gate 550.

The output of decoder 361 control, in part, the generation of the memory enable pulses by way of control of a first set of four memory enable AND gates 551. The four memory enable AND gates 551 respectively provide memory enable signals on outputs ME-1', ME-2', ME-3' and ME-4' to four memory enable AND gates 552. The four AND gates 552 produce the memory enable pulses on their respective outputs ME-1, ME-2, ME-3 and ME-4 in response to the signals from AND gates 551 when updating is permitted. The memory enable gates 551 also receive input signals from circuitry including an AND gate 554, an inverter 556 and a noninverting delay gate 558. These signals alter the time at which the memory enable pulses are generated.

The memory reset signals are provided by four sets of reset gates 560, 562, 564 and 566. Each set has four gates which are respectively connected in cascade. The reset gates are variously responsive to the states of the outputs of decoder 361, the stat of the UE output of an updat enable circuit 568, the stat of function latch output AM and the condition of the memory enable outputs ME-1 through ME-4. Control is also provided by the D13 reset enable pulse provided by NOR gate 442 and another delayed clock signal provided on the output of an inverting delay circuit 570.

With the function latch output AM in a 0-state, the update enable circuit 568 is disabled through connection of the AM output with a NAND gate 572 and a NAND gate 574. The AM 0-state signal maintains both the update enable output UE from NAND gate 572 and the output of NAND gate 574 in a 1-state. With output UE in a 1-state, all of the memory enable AND gates 552 connected therewith are enabled to respond to signals from memory enable gates 551. Likewise, an AND gate 576 connected with output UE and an AND gate 578 connected therewith and with the output of AND gate 574 are enabled to pass D13 reset enable pulses to reset NAND gates 562. NAND gates 562, in response thereto, generate 0-states to AND gates 566 in accordance with the output states of reset gates 560. Reset gates 560 output signals are controlled in turn by the output signals from decode 361.

The operation of the memory control circuit may be best understood by way of example. Memory counter 360 is reset to a zero count at the beginning of each third input enable period and is thus in a zero count at the beginning of each new first input enable period. With a zero count in the counter 360, a 1-state signal is present on the 0-NOTES output of decoder 361 and 0-state signals are present on the remaining outputs thereof. The four outputs of decoder 361 are respectively coupled to the four memory enable gates 551. Thus, only the first memory enable gate 551 is enabled to generate a 1-state pulse on its output ME-1' in response to the first valid input enable pulse.

Each of the memory enable gate 551 also has an input connected with the clock signal on output CP and an input connected with the output of AND gate 554. The output of AND gate 554 switches to a 1-state only when the delayed clock signal on output CP' of delay gate 558 is in a 1-state and the inverted valid input enable signal on output VI of inverter 556 is in a 1-state. Waveform (4) illustrates the delayed clock signal on output CP'.

The memory enable pulse produced on outputs ME-' and ME-1, which is the conjunction of the NAND gate 554 output and the clock signal on output CP, is shown by waveform (5). At all other times, AND gate 554 is in a +0-state. As can be seen, the memory enable pulse commences with the positive going transition of the delay clock signal, waveform (4), and terminates with the positive going transition of the memory counter input signal from NOR gate 550, waveform (3). This, of course, occurs only when a 1-state pulse is developed on output VI, waveform (2), in response to a code select pulse. At the end of the memory enable pulse on ME-1, the counter is advanced by one count. The second memory enable gate 552 is then enabled to respond to the next valid input pulse, while the others are not. With counts of two and three, the memory enable pulse is respectively generated on outputs ME-3 and ME-4. Again, as can be seen from comparing waveforms (3) and (5), the memory counter does not advance its count in response to a valid input signal until after the memory enable output signal developed therefrom is generated.

0-state memory reset pulses are respectively generated on outputs MR-1 through MR-4 in response to memory enable pulses generated on outputs ME-1 through ME-4. Outputs ME-1 through ME-4 are respectively connected to inputs of reset NAND gates 564 providing reset signals on their outputs MR-1' through MR-4', respectively, Each of NAND gates 564 also has an input connected with an output CP'' from inverting delay circuit 570. Inverting delay circuit 570 is driven by the clock pulse on output CP' from delay circuit 558. This inverted, delayed clock signal is illustrated in waveform (6) of FIG. 8*a*. As can be seen from viewing waveform (7) relative to waveform (5), the 0-state memory reset pulse is generated at a beginning portion of the 1-state memory enable pulse associated therewith. Thus, if a latch has not been reset since the last input enable scanning period, it is temporarily resets and cleared to receive new information in response to each new memory enable pulse.

If a memory enable pulse is not generated on the output of one of the memory enable gates 552, a 0-state memory reset pulse is not generated on the reset gate 566 associated therewith in the fashion described above. Rather, 0-state reset pulses are selectively generated by reset AND gates 566 in accordance with the count of counter 360 in response to the D13 reset enable pulse illustrated in waveform (8) of FIG. 8a.

Except during the thirteenth clock pulse occurring during the second input enable period, the D13 reset enable signal applied to the input of AND gate 576 is in a zero state. Thus, during this period of time, the outputs of all four memory reset gates 562 are in a 1-state, and all of the memory reset AND gates 566 are thereby enabled to respond to the memory enable pulses as discussed above.

As stated, if a memory enable pulse is not generated for a given latch, a reset pulse for that latch is also not generated. Thus, for instance, if an operator holds three keys down, three valid input pulses will be generated in succession, and the first three latches will be respectively reset and enabled to receive the note code corresponding thereto. However, a reset pulse will not be generated for the fourth latch. That latch, previously loaded with note code information, will still contain the information when the D13 reset enable pulse is generated. It is necessary to reset or clear this fourth latch, but not the other latches, in response to the D13 reset enable pulse. Accordingly, with only three valid input pulses having been generated, the memory counter 360 has a count of three, as indicated by a 1-state signal on the 3-NOTES output of decoder 361. This provides a 1-state signal on the output MR-4''' of OR gate 560 which enables the NAND gate 562 having input MR-4'' to switch to a 0-state in response to the D13 reset enable pulse. This 0-state pulse on output MR-4'' results in the generation of a corresponding 0-state reset pulse on output MR-4, and the fourth keynote latch is reset. Likewise, with counts of two, one and zero in the nonmemory mode of operation, 0-state reset pulses will be generated on outputs MR-4 and MR-3 on outputs MR-4, MR-3 and MR-2, and MR-4, MR-3, MR-2 and MR-1, respectively. With a count of four, none of the reset AND gates 566 generate reset pulses in response to the D13 reset enable pulse.

In the memory mode of operation, with the function latch output AM in a 1-state, the keynote latches may only be updated, i.e., reset and enabled to receive new codes, when the output UE of update enable circuit 568 is in a logic 1-state. Specifically, output UE is connected with one input of AND gate 576 and with an input of each of memory enable AND gates 552 and thus none of these gates may respond to signals applied to their other respective inputs when output UE is in a 0-state. A 1-state update enable pulse is only generated by update enable circuit 568 when an increase in the number of keys being held down from one input enable scanning period to the next is detected.

The latches are not updated upon detection of a decrease in the number of keys held down and continue to store the initially selected note code information. However, upon detection of a decrease in the number of keys down, the update enable circuit 568 is disabled for a preselected period to prevent response to a subsequent detection of an increase in the number of keys down. This disablement period is provided to prevent updating in response to spurious increased key down signals due to switch contact bounce or the like.

Unlike the memory control 164 of FIG. 6b, release of all keys being held down is not necessary to update the latches. For example, if the operator holds four keys down, then releases only one of the keys, update will not occur. However, as soon as a fourth key is again held down, thus increasing the number of keys down from three to four, update will occur with all note code latches being reset and loaded with the note codes corresponding to the keys being held down.

The update enable circuit 568 includes a 3-bit, memory control counter latch 582, a latch-counter comparator circuit 584 and an update enable control signal generating circuit 586. The memory control counter latch 582 stores the count of control counter 360 and comparator 584 makes a comparison to determine whether the new count in control counter 360 is greater or lesser than the previous count. If the count stored in latch 582 is greater than the count from control counter 360, indicating that the number of keys down has decreased, a 1-state signal is provided on output 588 of comparator 584. On the other hand, if the count stored in latch 582 is less than the count in control counter 360, indicating that the number of keys down has increased, a 1-state signal is developed on output 590 of comparator 584. At the end of the comparison, the new count of the counter is stored in the latch for comparison at the end of the next keynote scanning period.

Figure 8:
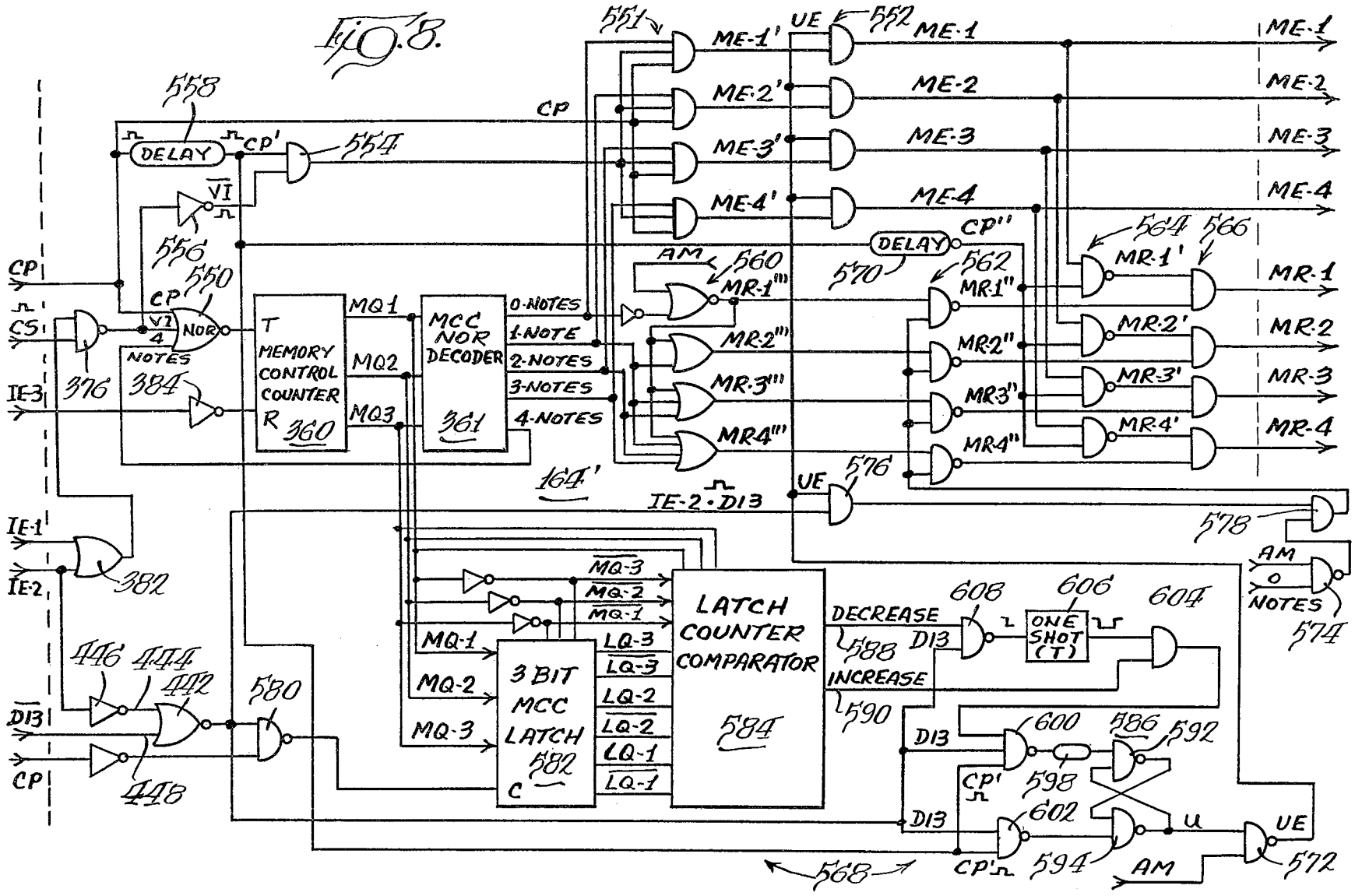
FIG. 8 is a circuit logic diagram of another form of the note memory control shown in block form in FIG. 3*c;*
Figure 8A:
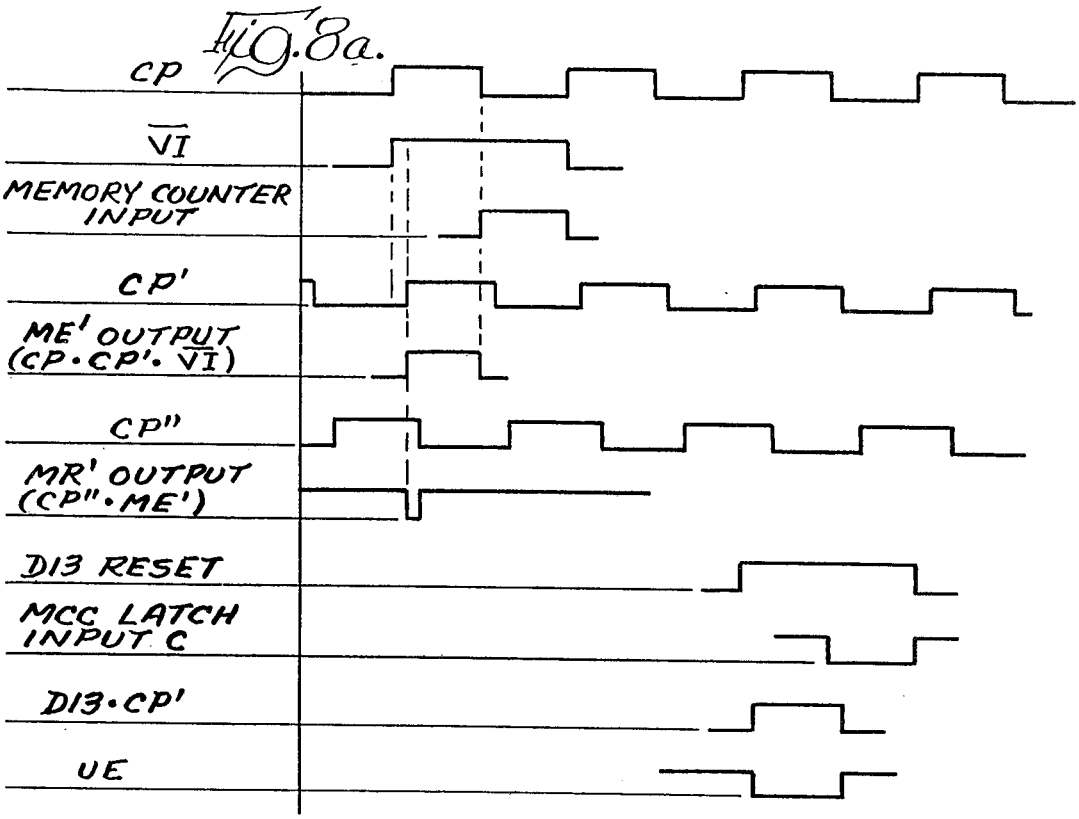
FIG. 8*a* is a comparative timing diagram for various signal waveforms developed or used by the memory control circuit of FIG. 8 during performance of its control function.
Figure 8B:
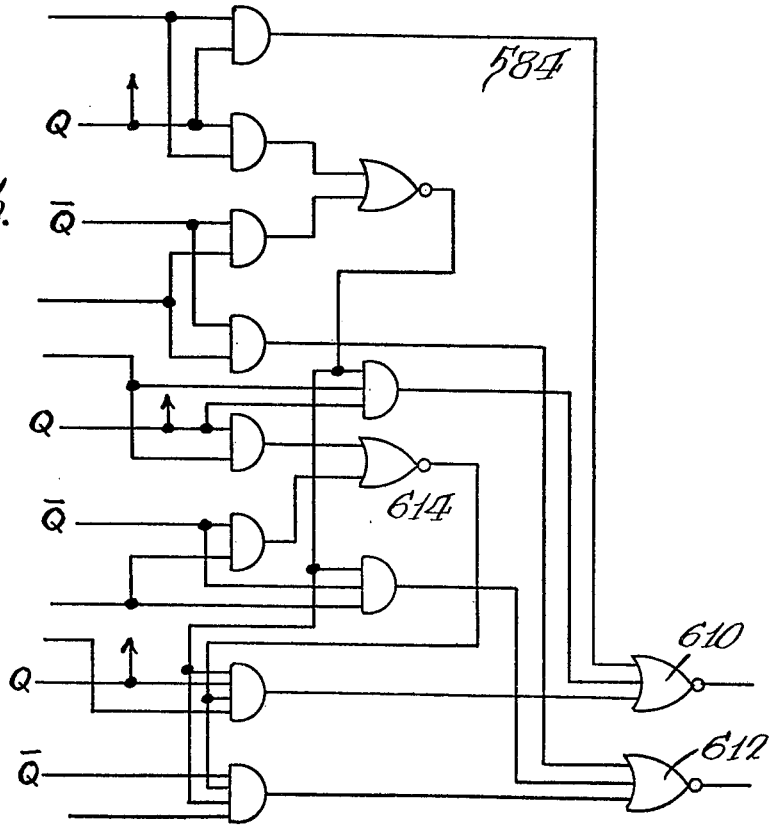
FIG. 8*b* is a logic diagram of the comparator circuit shown in block form of FIG. 8.

A schematic of the latch-counter comparator 584, shown in block form in FIG. 8, is illustrated in FIG. 8b, and the manner in which it performs the above-described function will be described hereinafter. The circuit 586, which is responsive to the comparator, includes a pair of NAND gates 592 and 594 connected together in a conventional latching configuration. At an appropriate decision point in the cycle, the update enable latch is set into a state in which the output U of NAND gate 594 is in a 0-state, if a 1-state signal is being provided on increase output 590. If a 1-state signal is not being provided at the decision point, indicating that there has not been an increase in the number of keys down, the update enable latch is set into a condition with a 1-state signal on output U. A 1-state signal on output U results in a 0-state update enable signal on output UE of NAND gate 572 which inhibits generation of both memory enable and memory reset pulses. A 0-state signal on output U results in a 1-state signal on output UE, and the note latches may be reset and loaded with new note code information in the same fashion as if the accompaniment memory latch output AM were in a 0-state, with minor exceptions.

One exception is that with the AM output in a 1-state, the first NOR gate 560 is in a 0-state, its associated NAND gate 562 output MR-1″ is in a 1-state, and the first AND gate 566 is always disabled from responding to the D13 reset pulse. The remaining exception is that, due to an input to NAND gate 574 from the 0-NOTES output of decoder 361, all of NAND gates 562 are prevented from generating 0-state reset pulses in response to the D13 reset pulse whenever the 0-NOTES output of decoder 361 is in a 1-state.

The state of update enable latch is controlled by signals developed by circuitry connected with the outputs 588 and 590 of comparator 584. The NAND gate 592 of the update enable latch receives its set input through a delay gate 598 from the output of a set NAND gate 600. NAND gate 594 receives a reset input from the output of a reset NAND gate 602. Both NAND gate 600 and 602 receive input signals from the delayed clock and output CP′ and the D13 output of NOR gate 442. The NAND gate 600 also receives a third input signal from the output of an AND gate 604. AND gate 604 receives one input from the output of a monostable multivibrator or one-shot 606, and another input from the output 590 of comparator 584. The one-shot 606 is driven from the output of a NAND gate 608. NAND gate 608 receives one input from the output 588 of comparator 584 and another input from the D13 output of NOR gate 442.

The operation timing sequence of circuit 586 can best be understood by reference to waveforms (8), (9), (10) and (11) of FIG. 8*a*. When both D13 and CP′ are in a 1-state, NAND gate 602 switches to a 0-state. If a 1-state is on the output of AND gate 604 at this time, indicating that an increased number of keys down has been detected by comparator 584, NAND gate 600 also switches to a 0-state. If output U is in a 0-state at this time, it switches to a 1-state at the beginning of the pulse illustrated in waveform (10). This results in output UE switching to a 0-state, as illustrated by the broken line illustration of the UE signal shown in waveform (11). If, on the other hand, output U is in a 1-state at this time, it remains in a 1-state. If a 1-state is on output 590, however, a 0-state pulse is also generated on the output of NAND gate 600. This pulse also occurs during the same time as the pulse shown in waveform (10). However, this pulse, before it is applied to NAND gate 592, is delayed by a small preselected amount, less than a pulse width, by delay gate 598. Accordingly, when the 0-state pulse at the output of NAND gate 602 terminates, the output of NAND gate 592 is in a 1-state and the output gate of NAND gate 594 switches to a 0-state. The 0-state on output U results in the application of a 1-state update enable pulse on output UE of NAND gate 572, as illustrated in solid line in waveform (11).

Immediately after this time, a positive going transition of a 0-state pulse is developed on the output of NAND gate 580 and is applied to the C input of latch 582. This pulse, which is illustrated in waveform (9), causes the new count in decoder 361 to be stored in latch 582. The UE output remains in a 1-state throughout the next first and second input enable periods, thereby allowing updating of the note code latches. If the number of keys down is not again increased, the update enable latch is again switched to its set position and the UE output again switches to its 0-state, as described above.

To prevent the bounce of a keynote switch upon being released from causing a spurious signal from the comparator to be applied to AND gate 604, the circuitry including one-shot 606 and NAND gate 608 is provided. When a key is released, a 1-state signal is generated on output 588. If this 1-state signal is present at the beginning of the D13 reset enable pulse illustrated in waveform (8), a 0-state pulse is generated on the output of AND gate 608. This causes one-shot 606 to switch to its unstable 0-state for a preselected time period. During this time period, AND gate 604 is disabled from generating a 1-state signal in response to a spurious 1-state increase signal provided on output 590. This time period may be on the order of 20 milliseconds. At the end of the time period, the one-shot returns to its stable 1-state condition, and AND gate 604 is again enabled to respond to increased key down signals.

Referring to FIG. 8*b*, the latch-counter comparator 584 is seen to develop the 1-state output pulses on the outputs of two NOR gates 612 and 610, respectively. Each of these NOR gates receives three inputs from comparator gating circuitry 614 comprising a plurality of NOR gates and AND gates. These gates are connected with one another and with all of the normal and inverted outputs of both the memory control counter 360 and the 3-bit memory control counter latch 582 in such a fashion that 0-state signals are applied to all three inputs of NOR gate 610 when the count stored in latch 582 is greater than that of counter 360 and to provide 0-state signals on all three inputs to NOR gate 612 whenever the count of counter 360 is greater than that stored in latch 582. When the count stored in latch 582 is equal to that of counter 360, neither one of the NOR gates 610 and 612 provides a 1-state signal on its output.

Having described the invention, the embodiments of the invention in which an exclusive property or privilege is claimed are defined as follows:

1. In a musical instrument having means for generating tone signals and means for providing information representative of a plurality of selected ones of said tone signals, a circuit for producing selected ones of said plurality of tone signals in accordance with said information, comprising:

tone selector means connected with said tone signal generating means and said information providing means for producing a selected one of the tone signals on an output thereof when information representative of a selected tone signal is received on an input thereof;

multiplexing means connected with said information providing means for transferring the information provided thereby to an input of the tone selector means on a time division multiplexing basis, said tone selector selectively producing time division multiplexed tone signals on an output thereof in accordance with said information; and means connected with the output of the tone selector means for demultiplexing the selected multiplexed tone signals.

2. The musical instrument of claim 1 in which said multiplexing means includes:

information select means connected with said information providing means for transferring the selected tone signal information to the tone selector, and means for successively enabling said information select means to transfer the information representative of said plurality of tones, the information of only one selected tone signal being transferred at a time.

3. The musical instrument of claim 1 including means for providing octave information for each of the plurality of selected tone signals, a plurality of octave select means connected with the demultiplexing means, and means for providing the octave information of each selected tone signal to said plurality of octave select means, respectively, each of said octave select means reducing the frequency of the demultiplexing tone signal in accordance with said octave information.

4. The musical instrument of claim 1 in which said information is provided at a multiplexing frequency greater than that of the highest frequency tone signal, and said transferring multiplexing means multiplexes the provided information at a frequency greater than the information providing multiplexing frequency.

5. The musical instrument of claim 1 in which said means includes a plurality of multiplexing units in information selector units respectively receiving the information representative of said plurality of selected tones, each tone selector unit receiving the information of only one selected tone signal with all of the tone selector units simultaneously receiving the selected tone information, and means for successively applying multiplex enable signals to said selector units one at a time, each selector unit transferring the information being received thereby to the tone selector means during the application of the multiplex enable signal thereto.

6. The musical instrument of claim 2 in which said demultiplexing means includes a plurality of demultiplexing units for respectively demultiplexing the plurality of multiplexed tone signals, and means for successively enabling the demultiplexing units in synchronism with the successive enabling of the information select means.

7. The musical instrument of claim 6 in which said tone selector means comprises a plurality of information selector units respectively receiving the information representative of said plurality of selected tones, each tone selector unit receiving the information of only one selected tone signal with all of the tone selector units simultaneously receiving the selected tone information.

8. The musical instrument of claim 7 in which said successively enabling means includes means for successively applying multiplex enable signals to said selector units one at a time, each selector unit transferring the information being received thereby to the tone selector means during the application of the multiplex enable signal thereto.

9. The musical instrument of claim 7 wherein said demultiplexing means includes a plurality of demultiplexing units, said demultiplexing units being successively enabled in synchronism with the successive enabling of the information selector units for respectively demultiplexing the plurality of multiplexed tone signals.

10. The musical instrument of claim 8 in which the information representative of ech tone signal is a binary note code, and each information selector units includes means to simultaneously transfer all bits of the binary code to the tone selector when enabled.

11. The musical instrument of claim 10 in which said tone selector means comprises a plurality of gates respectively connected with a plurality of tone signal generating sources, each of said gates being responsive to receipt of a binary code associated therewith to transfer the tone signal from its source to an output of the tone selector means.

12. The musical instrument of claim 11 in which each gate transfers its associated tone signal only so long as the associated code is being received by the tone selector means, each code being received by the tone selector means simultaneously with the generation of the associated multiplex enable signal.

13. The musical instrument of claim 9 wherein all of said demultiplexing units receive said multiplexed tone signals from a single input of the demultiplexing means, and each demultiplexing unit has an output on which one demultiplexed tone signal is produced, the plurality of demultiplexed tone signals being respectively produced on the individual outputs of said plurality of demultiplexing units.

14. The musical instrument of claim 10 in which the frequencies of said tone signals are less than the frequency at which said multiplex enable signals are generated said tone signals alternating between two states and each demultiplexing unit includes:

a latch with an output switchable between first and second states, means for switching the latch into one of said states in response to a multiplex enable signal and one state of said multiplexed tone signal, and means for switching the latch into its other state in response to the other state of said multiplexed signals when the latch is enabled.

15. The musical instrument of claim 14 in which said information providing means includes means for providing octave information for each of the plurality of selected tone signals, and including:

a plurality of octave select means respectively connected with the outputs of said plurality of demultiplexing units, and means for providing the octave information of each selected tone signal to said plurality of octave select means, each of said octave select means reducing the frequency of the tone signal from the demultiplexing unit connected therewith in accordance with said octave information.

16. In a musical instrument having means for generating one signals and means for providing information representative of a plurality of selected ones of said tone signals, a circuit for producing said plurality of selected tone signals in accordance with said information, comprising:

tone selector means connected with said tone signal generating means for producing a selected one of the tone signals on an output thereof when multiplexed information representative of a selected tone signal is transferred thereto;

means for controlling the tone selector means to produce time division multiplexed tone signals on an output thereof in accordance with said information; and means connected with the output of the tone selector means for demultiplexing the selected multiplexed tone signals, said demultiplexing means including a plurality of demultiplexing units, and means for successively enabling the demultiplexing units in synchronism with the multiplexed transfer of information to the tone selector means, each demultiplexing unit demultiplexing a different one of said tone signals.

17. The musical instrument of claim 16 wherein all of said demultiplexing units receive said multiplexed tone signals from a single input of the demultiplexing means, and each demultiplexing unit has an output on which one demultiplexed tone signal is produced.

18. The musical instrument of claim 16 in which said tone signals are signals alternating between first and second conditions at a frequency less than the frequency at which said demultiplexing units are successively enabled and each demultiplexing unit includes:

a latch with an output switchable between first and second states, means for switching the latch into one of said states in response to the multiplexed signal being in one of its conditions with the latch is enabled, and means for switching the latch into its other state in response to the multiplxed signal being in the other condition when the latch is enabled

19. The musical instrument of claim 18 including means associated with said information providing means for providing octave information for each of the plurality of selected tone signals, a plurality of octave select means respectively connected with the outputs of said plurality of demultiplexing units, and means for providing the octave information of each selected tone signal to said plurality of octve select means, respectively, each of said octave select means reducing the frequency of the tone signal from the demultiplexing unit connected therewith in accordance with said octave information.

* * * * *